US008851164B2

(12) United States Patent
Ellis et al.

(10) Patent No.: US 8,851,164 B2
(45) **Date of Patent: *Oct. 7, 2014**

(54) TUBULAR HANDLING DEVICE AND METHODS

(75) Inventors: Brian Ellis, Houston, TX (US); Craig Weems, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 40 days.

This patent is subject to a terminal disclaimer.

(21) Appl. No.: 13/293,962

(22) Filed: Nov. 10, 2011

(65) Prior Publication Data

US 2012/0097402 A1 Apr. 26, 2012

Related U.S. Application Data

(63) Continuation of application No. 12/147,223, filed on Jun. 26, 2008, now Pat. No. 8,074,711.

(51) Int. Cl.
*E21B 19/16* (2006.01)
*E21B 19/07* (2006.01)

(52) U.S. Cl.
CPC ..... *E21B 19/07* (2013.01)
USPC ..... 166/77.51; 166/380

(58) Field of Classification Search
CPC ..... E21B 19/07
USPC ..... 166/77.1, 77.51, 77.52, 77.53, 98, 166/379–380
See application file for complete search history.

(56) References Cited

U.S. PATENT DOCUMENTS

| | | | |
|---|---|---|---|
| 1,486,471 | A | 3/1924 | Wilcox |
| 1,829,760 | A | 11/1931 | Santiago |
| 1,917,699 | A | 7/1933 | Casablancas |
| 2,178,999 | A | 11/1939 | Scott |
| 2,203,118 | A | 6/1940 | Williams |

(Continued)

FOREIGN PATENT DOCUMENTS

| | | |
|---|---|---|
| CA | 2512570 | 1/2006 |
| GB | 2155577 | 9/1985 |

(Continued)

OTHER PUBLICATIONS

Det Norske Veritas, "Technical Report: BSW Limited Design and Engineering: Testing of Ballgrab Anchor Connector," Report No. 2002-3263, Jul. 31, 2002, http://www.ballgrab.co.uk/downloads/dnvfatiguereport.pdf.

(Continued)

*Primary Examiner* — James Sayre
(74) *Attorney, Agent, or Firm* — Haynes and Boone, LLP

(57) ABSTRACT

A tubular member handling apparatus including a tubular member running tool, an elevator, first actuators each extending between the running tool and the elevator, and second actuators each extending between the running tool and a corresponding first actuator. The running tool includes a slotted member having a plurality of elongated slots, a recessed member slidably coupled to the slotted member and having a plurality of recesses, and a plurality of rolling members each retained between one of the recesses and one of the slots. Each rolling member partially extends through an adjacent slot when located in a shallow end of a corresponding recess, and retracts to within an outer perimeter of the slotted member when located in a deep end of the corresponding recess.

24 Claims, 16 Drawing Sheets

(56) References Cited

U.S. PATENT DOCUMENTS

| | | | | |
|---|---|---|---|---|
| 2,211,016 | A | 8/1940 | Krell | |
| 2,775,304 | A | 12/1956 | Zandmer | |
| 3,522,966 | A | 8/1970 | Wood | |
| 3,540,533 | A | 11/1970 | Morrill | |
| 3,543,847 | A | 12/1970 | Haeber | |
| 3,897,099 | A | 7/1975 | Scodino et al. | |
| 4,042,231 | A | 8/1977 | Kopczynski et al. | |
| 4,114,404 | A | 9/1978 | Phelps | |
| 4,444,252 | A | 4/1984 | Fisher, Jr. | |
| 4,448,255 | A | 5/1984 | Shaffer et al. | |
| 4,643,472 | A | 2/1987 | Schukei et al. | |
| 4,647,099 | A | 3/1987 | Berry et al. | |
| 4,676,312 | A | 6/1987 | Mosing et al. | |
| 4,793,422 | A | 12/1988 | Krasnov | |
| 4,811,784 | A | 3/1989 | Theiss | |
| 4,971,146 | A | 11/1990 | Terrell | |
| 5,082,061 | A | 1/1992 | Dollison | |
| 5,125,148 | A | 6/1992 | Krasnov | |
| 5,330,002 | A | 7/1994 | Saunders | |
| 5,340,182 | A | 8/1994 | Busink et al. | |
| 5,484,222 | A | 1/1996 | Schulze-Beckinghausen | |
| 5,553,667 | A | 9/1996 | Budde et al. | |
| 5,749,585 | A | 5/1998 | Lembcke | |
| 5,967,477 | A * | 10/1999 | Walmsley | 248/230.2 |
| 6,302,199 | B1 | 10/2001 | Hawkins et al. | |
| 6,305,649 | B1 | 10/2001 | Walmsley et al. | |
| 6,352,115 | B1 | 3/2002 | Mathieu | |
| 6,354,372 | B1 | 3/2002 | Carisella et al. | |
| 6,443,241 | B1 | 9/2002 | Juhasz et al. | |
| 6,536,520 | B1 | 3/2003 | Snider et al. | |
| 6,550,128 | B1 | 4/2003 | Lorenz | |
| 6,557,641 | B2 | 5/2003 | Mosing et al. | |
| 6,591,904 | B2 | 7/2003 | Cicognani | |
| 6,609,573 | B1 | 8/2003 | Day | |
| 6,622,796 | B1 | 9/2003 | Pietras | |
| 6,622,797 | B2 | 9/2003 | Sivley, IV | |
| 6,637,526 | B2 | 10/2003 | Juhasz et al. | |
| 6,644,413 | B2 | 11/2003 | Adams et al. | |
| 6,679,333 | B2 | 1/2004 | York et al. | |
| 6,681,861 | B2 | 1/2004 | Davidson et al. | |
| 6,688,398 | B2 | 2/2004 | Pietras | |
| 6,691,776 | B2 | 2/2004 | Guillory et al. | |
| 6,695,050 | B2 | 2/2004 | Winslow et al. | |
| 6,705,405 | B1 | 3/2004 | Pietras | |
| 6,719,063 | B2 | 4/2004 | Adams et al. | |
| 6,742,596 | B2 | 6/2004 | Haugen | |
| 6,752,569 | B2 | 6/2004 | Emmett | |
| 6,779,614 | B2 | 8/2004 | Oser | |
| 6,814,140 | B2 | 11/2004 | Robichaux | |
| 6,854,515 | B2 | 2/2005 | Matthews et al. | |
| 6,857,483 | B1 | 2/2005 | Dirks et al. | |
| 6,913,096 | B1 | 7/2005 | Nielsen et al. | |
| 6,920,926 | B2 | 7/2005 | York et al. | |
| 6,938,709 | B2 | 9/2005 | Juhasz et al. | |
| 6,966,385 | B2 | 11/2005 | Hemphill et al. | |
| 6,976,298 | B1 | 12/2005 | Pietras | |
| 6,991,265 | B2 | 1/2006 | Walmsley et al. | |
| 7,004,259 | B2 | 2/2006 | Pietras | |
| 7,021,374 | B2 | 4/2006 | Pietras | |
| 7,055,609 | B2 | 6/2006 | Hayes et al. | |
| 7,073,598 | B2 | 7/2006 | Haugen | |
| 7,090,021 | B2 | 8/2006 | Pietras | |
| 7,096,977 | B2 | 8/2006 | Juhasz et al. | |
| 7,128,161 | B2 | 10/2006 | Pietras | |
| 7,134,531 | B2 | 11/2006 | Ramey et al. | |
| 7,137,454 | B2 | 11/2006 | Pietras | |
| 7,140,443 | B2 | 11/2006 | Beierbach et al. | |
| 7,191,840 | B2 | 3/2007 | Pietras et al. | |
| 7,217,056 | B2 | 5/2007 | Cooper | |
| 7,325,610 | B2 | 2/2008 | Giroux et al. | |
| 7,350,586 | B2 | 4/2008 | Guidry | |
| 7,353,026 | B2 | 4/2008 | Lee | |
| 7,370,707 | B2 | 5/2008 | McDaniel et al. | |
| 7,377,324 | B2 | 5/2008 | Beierbach et al. | |
| 7,438,127 | B2 | 10/2008 | Lesko | |
| 7,445,050 | B2 | 11/2008 | Kuttel et al. | |
| 7,552,764 | B2 | 6/2009 | Weems et al. | |
| 2001/0042625 | A1 | 11/2001 | Appleton | |
| 2002/0070027 | A1 | 6/2002 | Ohmer et al. | |
| 2003/0000708 | A1 | 1/2003 | Coone | |
| 2003/0127222 | A1 | 7/2003 | Marcin et al. | |
| 2003/0173073 | A1 | 9/2003 | Snider et al. | |
| 2003/0196791 | A1 | 10/2003 | Dunn et al. | |
| 2004/0084191 | A1 | 5/2004 | Laird | |
| 2004/0216924 | A1 * | 11/2004 | Pietras et al. | 175/57 |
| 2004/0251050 | A1 | 12/2004 | Shahin et al. | |
| 2005/0061548 | A1 | 3/2005 | Hooper et al. | |
| 2005/0160881 | A1 | 7/2005 | Niven | |
| 2006/0000600 | A1 | 1/2006 | Pietras et al. | |
| 2006/0102337 | A1 | 5/2006 | Elliott et al. | |
| 2007/0074876 | A1 | 4/2007 | Pietras | |
| 2007/0251700 | A1 | 11/2007 | Mason et al. | |
| 2007/0261857 | A1 * | 11/2007 | Kuttel et al. | 166/380 |
| 2009/0101361 | A1 | 4/2009 | Mason et al. | |

FOREIGN PATENT DOCUMENTS

| | | |
|---|---|---|
| WO | WO 2007/124418 A3 | 11/2007 |
| WO | WO 2007/127737 A3 | 11/2007 |
| WO | WO 2009/025832 | 2/2009 |
| WO | WO 2011/056163 | 5/2011 |

OTHER PUBLICATIONS

European Patent Office, "International Search Report—PCT/US2009/048507," mailed Feb. 1, 2010.

European Patent Office, "Written Opinion of the International Searching Authority—PCT/US2009/048507," mailed Feb. 1, 2010.

* cited by examiner

TUBULAR HANDLING DEVICE AND METHODS

CROSS-REFERENCE TO RELATED APPLICATIONS

This application is a continuation application of U.S. patent application Ser. No. 12/147,223, filed Jun. 26, 2008, now U.S. Pat. No. 8,074,711 now allowed, the contents of which is hereby incorporated herein by express reference thereto.

BACKGROUND

The drilling of subterranean wells involves assembling tubular strings, such as casing strings and drill strings, each of which comprises a plurality of heavy, elongated tubular segments extending downwardly from a drilling rig into a wellbore. The tubular string consists of a number of threadedly engaged tubular segments.

Conventionally, workers use a labor-intensive method to couple tubular segments to form a tubular string. This method involves the use of workers, typically a "stabber" and a tong operator. The stabber manually aligns the lower end of a tubular segment with the upper end of the existing tubular string, and the tong operator engages the tongs to rotate the segment, threadedly connecting it to the tubular string. While such a method is effective, it is dangerous, cumbersome and inefficient. Additionally, the tongs require multiple workers for proper engagement of the tubular segment and to couple the tubular segment to the tubular string. Thus, such a method is labor-intensive and therefore costly. Furthermore, using tongs can require the use of scaffolding or other like structures, which endangers workers.

Others have proposed a running tool utilizing a conventional top drive assembly for assembling tubular strings. The running tool includes a manipulator, which engages a tubular segment and raises the tubular segment up into a power assist elevator, which relies on applied energy to hold the tubular segment. The elevator couples to the top drive, which rotates the elevator. Thus, the tubular segment contacts a tubular string and the top drive rotates the tubular segment and threadedly engages it with the tubular string.

While such a tool provides benefits over the more conventional systems used to assemble tubular strings, it also suffers from shortcomings. One such shortcoming is that the tubular segment might be scarred by the elevator gripping dies. Another shortcoming is that a conventional manipulator arm cannot remove single joint tubulars and lay them down on the pipe deck without worker involvement.

Other tools have been proposed to cure these shortcomings. However, such tools are often unable to handle tubulars that are dimensionally non-uniform. When the tubulars being handled are not dimensionally ideal, such as by having a varying wall thickness or imperfect cylindricity or circularity, the ability of tools to adequately engage the tubulars is decreased.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF PREFERRED EMBODIMENTS

Figure 1A:
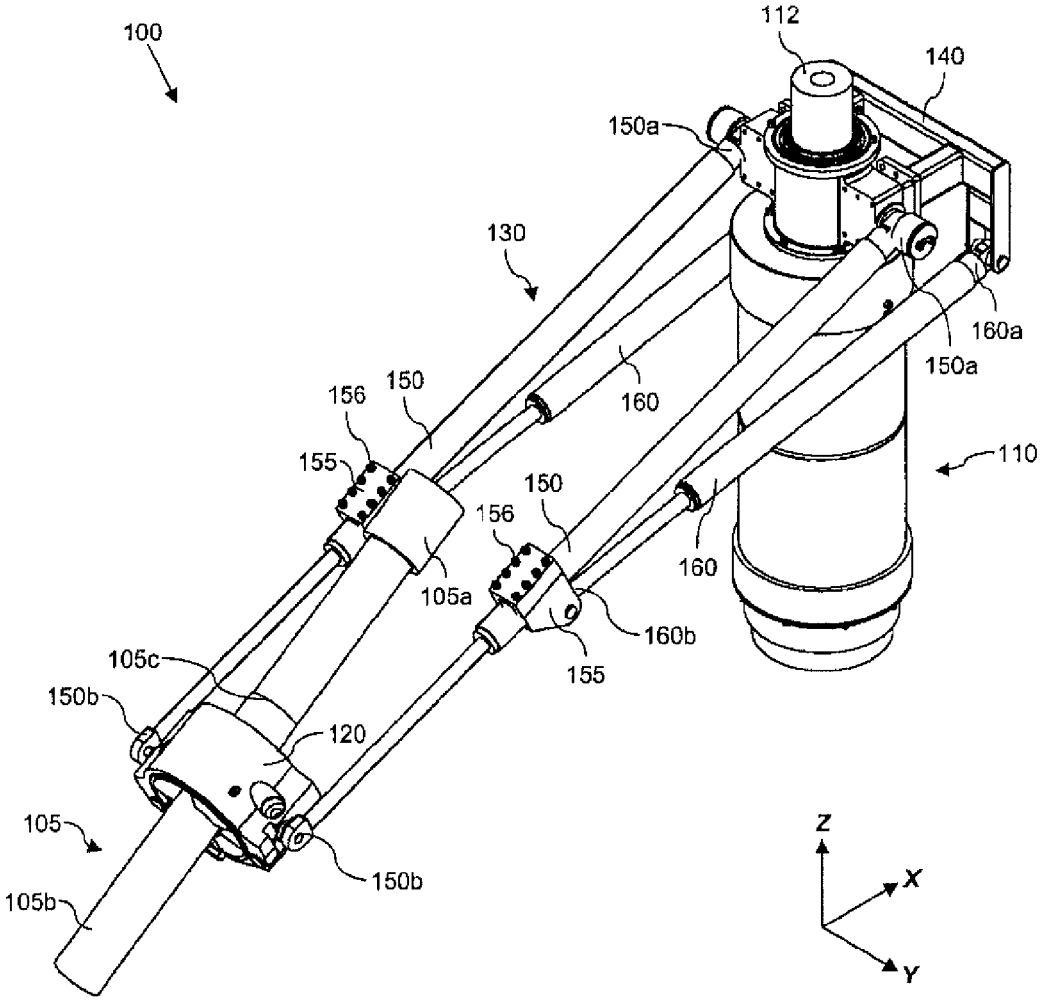
FIG. 1A is a perspective view of at least a portion of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a perspective view of at least a portion of an apparatus 100 according to one or more aspects of the present disclosure. The apparatus 100 comprises a tubular member running tool 110, a tubular member elevator 120, and a link tilt assembly 130.

The running tool 110 is configured to receive and at least temporarily grip, frictionally engage, or otherwise retain a tubular member 105. For example, the running tool 110 may be configured to grip or otherwise engage an interior surface of the tubular member 105, an exterior surface of the tubular member 105, or both an interior surface and an exterior surface of the tubular member 105, or portions thereof. The extent to which the running tool 110 frictionally engages or otherwise retains the tubular member 105 may be sufficient to support a safe working load (SWL) of at least 5 tons. However, other SWL values for the running tool 110 are also within the scope of the present disclosure.

The extent to which the running tool 110 frictionally engages or otherwise retains the tubular member 105 may also be sufficient to impart a torsional force to the tubular member 105, such as may be transmitted through the running tool 110 from a top drive or other component of the drill string. In an exemplary embodiment, the torque which may be applied to the tubular member 105 via the running tool 110 may be at least about 5000 ft-lbs, which may be sufficient to "make-up" a connection between the tubular member 105 and another tubular member. The torque which may be applied to the tubular member 105 may additionally or alternatively be at least about 50,000 ft-lbs, which may be sufficient to "break" a connection between the tubular member 105 and another tubular member. However, other torque values are also within the scope of the present disclosure.

The tubular member 105 may be a wellbore casing member, a drill string tubing member, a pipe member, a collared tubing member, and/or other tubular elements. The tubular member 105 may be a single tubular section, or pre-assembled double or triple sections. In an exemplary embodiment, the tubular member 105 may be or comprise one, two, or three sections of collared or integral joint or threaded pipe, such as may be utilized as a portion of a tubing, casing, or drill string. The tubular member 105 may alternatively be or comprise a section of a pipeline, such as may be utilized in the transport of liquid and/or fluid materials. The tubular member 105 may alternatively be or comprise one or more other tubular structural members. The tubular member 105 may have an annulus cross-section having a substantially cylindrical, rectangular or other geometric shape.

In an exemplary embodiment, at least a portion of the running tool 110 is substantially similar to the tubular member running tool or handling apparatus described in commonly-assigned U.S. Pat. No. 7,445,050, entitled "Tubular Running Tool," and/or U.S. Pat. No. 7,552,764, entitled "Tubular Handling Device," the disclosure of each of which is incorporated herein in its entirety by express reference thereto. For example, one or more operational principles, components, and/or other aspects of the apparatus described in the above-incorporated references may be implemented within one or more embodiments of the running tool 110 within the scope of the present disclosure.

The running tool 110 is configured to be engaged by or otherwise interfaced with a top drive or drill string section or component. For example, as schematically represented in the exemplary embodiment shown in FIG. 1A, the running tool 110 may comprise an interface 112 configured to mate, couple, or otherwise interface with the quill, housing, and/or other component of the top drive or component of the drill string. In an exemplary embodiment, the interface 112 comprises one half of a standard box-pin coupling commonly employed in drilling operations. However, other interfaces are also within the scope of the present disclosure.

The elevator 120 is also configured to receive and at least temporarily grip, frictionally engage, or otherwise retain the tubular member 105. For example, the elevator 120 may be configured to grip or otherwise engage an interior surface of the tubular member 105, an exterior surface of the tubular member 105, or an interior surface and an exterior surface of the tubular member 105, or portions thereof. The extent to which the elevator 120 frictionally engages or otherwise retains the tubular member 105 may be sufficient to support a safe working load (SWL) of at least 5 tons. However, other SWL values for the elevator 120 are also within the scope of the present disclosure.

In an exemplary embodiment, at least a portion of the elevator 120 is substantially similar to the tubular member running tool or other handling apparatus described in commonly-assigned U.S. Pat. No. 7,445,050, entitled "Tubular Running Tool," and/or U.S. Pat. No. 7,552,764, entitled "Tubular Handling Device" or otherwise has one or more similar aspects or operational principles. However, the elevator 120 may alternatively comprise a series of shoes, pads, and/or other friction members configured to radially constrict around the outer surface of the tubular member 105 and thereby retain the tubular member 105, among other configurations within the scope of the present disclosure.

Although both the running tool 110 and the elevator 120 are configured to engage the tubular member 105, the running tool 110 is configured and/or controllable to engage an end portion 105*a* of the tubular member 105 by the radial enlargement of the tool enabling the enlarged tubular element 105*a* to pass unimpeded into the tool 110, whereupon the gripping elements of the tool engage the pipe in the reduced portion 105*c*. However, the elevator 120 is configured and/or controllable to engage an axially-intermediate portion 105*b* of the tubular member. For example, the running tool 110 may be configured to engage the radially enlarged shoulder often exhibited by conventional drilling joints, whereas the elevator 120 may be configured to engage the smaller diameter of the remaining length of the joint.

The link tilt assembly 130 comprises a bracket 140, two actuators 150 each extending between the running tool 110 and the elevator 120, and two other actuators 160 each extending between the bracket 140 and a corresponding one of the actuators 130. An alternative approach could include a rotary actuator on the end of pivot 150*a* in conjunction with the linear actuator 150. The ends of each actuator 150, 160 may be configured to be rotatable, such as by comprising a structural loop or hook through which a pin or other coupling means may be secured. Thus, the ends 150*a* of the actuators 150 may be rotatably coupled to the running tool 110 or intermediate structure coupled to the running tool 110, and the opposing ends 150*b* of the actuators 150 may be rotatably coupled to the elevator 120 or intermediate structure coupled to the elevator 120. Similarly, the ends 160*a* of the actuators 160 may be rotatably coupled to the bracket 140, and the opposing ends 160*b* of the actuators 160 may be rotatably coupled to the actuators 150 or intermediate structure coupled to the actuators 150.

In the exemplary embodiment shown in FIG. 1A, the end 160*b* of each actuator 160 is rotatably coupled to a corresponding bracket 155, which is positionally fixed relative to the corresponding actuator 150 at an intermediate position between the ends 150*a*, 150*b* of the actuator 150. Each bracket 155 may have a U-shaped profile or otherwise be configured to receive and rotatably couple with the end 160*b* of the corresponding actuator 160. The brackets 155 may be coupled to the corresponding actuator 150 via one or more bolts 156, as shown in FIG. 1A, although other fastening means may also be employed.

The end points 160*a* of the actuators 160 are offset from the end points 150*a* of the actuators 150 such that the extension and retraction of the actuators 160 operates to rotate the actuators 150 relative to the running tool 110. For example, the end points 160*a* are each offset from the associated end points 150*a* in both the X and Z directions according to the coordinate system depicted in FIG. 1A. In other embodiments, however, the end points 160*a* may each be offset from the associated end points 150*a* in only one of the X and Z directions while still being configured to enable rotation of the actuators 150 relative to the running tool 110 (i.e., rotation about an axis extending through both end points 150*a* and parallel to the Y-axis of the coordinate system shown in FIG. 1A).

Each of the actuators 150 and the actuators 160 may be or comprise a linearly actuated cylinder which is operable hydraulically, electrically, mechanically, pneumatically, or via a combination thereof. In the exemplary embodiment shown in FIG. 1A, each actuator 150, 160 comprises a cylindrical housing from which a single cylindrical rod (e.g., a piston) extends. In other embodiments, however, one or more of the actuators 150, 160 may comprise a multi-stage actuator comprising more than one housing and/or cylinder, perhaps in a telescoping configuration, thus enabling a greater amount of travel and/or a more compact solution, among other possible advantages.

In the illustrated embodiment, each actuator 150 comprises a cylinder coupled to the running tool 110, wherein a rod extends from the cylinder and is rotatably coupled to the elevator 120. In addition, each actuator 160 comprises a cylinder coupled to the bracket 140 of the running tool 110, wherein a rod extends from the opposite end of the cylinder and is rotatably coupled to the corresponding bracket 155. Each bracket 155 is coupled to the cylinder of the corresponding actuator 150 near the end of the cylinder from which the rod extends. However, other configurations of the link tilt assembly 130 are also within the scope of the present disclosure.

The configuration depicted in FIG. 1A may be that of an initial or intermediate stage of preparing the tubular member for assembly into the drill string. Thus, the actuators 160 may have been extended to rotate the actuators 150 away from the centerline of the drill string, and the actuators 150 may have been extended to initially position the elevator 120 around the axially intermediate portion 105*b* of the tubular member 105. In practice, each tubular member 105 may have an elevator gripping limit 105*c* defining the axially intermediate portion 105*b* within which the elevator 120 should be positioned prior to gripping the tubular member 105. In some embodiments, operating the elevator 120 to grip the tubular member 105 beyond the limit 105*c* (i.e., too close to the end 105*a*), may mechanically damage the tubular member 105, thus reducing its operational life. In an exemplary embodiment, the limit 105*c* may be about two feet from the end 105*a* of the tubular member 105, or perhaps about 5-10% of the total length of the tubular member 105. However, the exact location of the limit 105*c* may vary within the scope of the present disclosure. For example, the distance separating the end 105*a* of the tubular member 105 from the gripping limit 105*e* may be about equal to or at least slightly larger than the distance to which the tubular member 105 is to be inserted into the running tool 110, as shown in subsequent figures and described below.

Figure 1B:
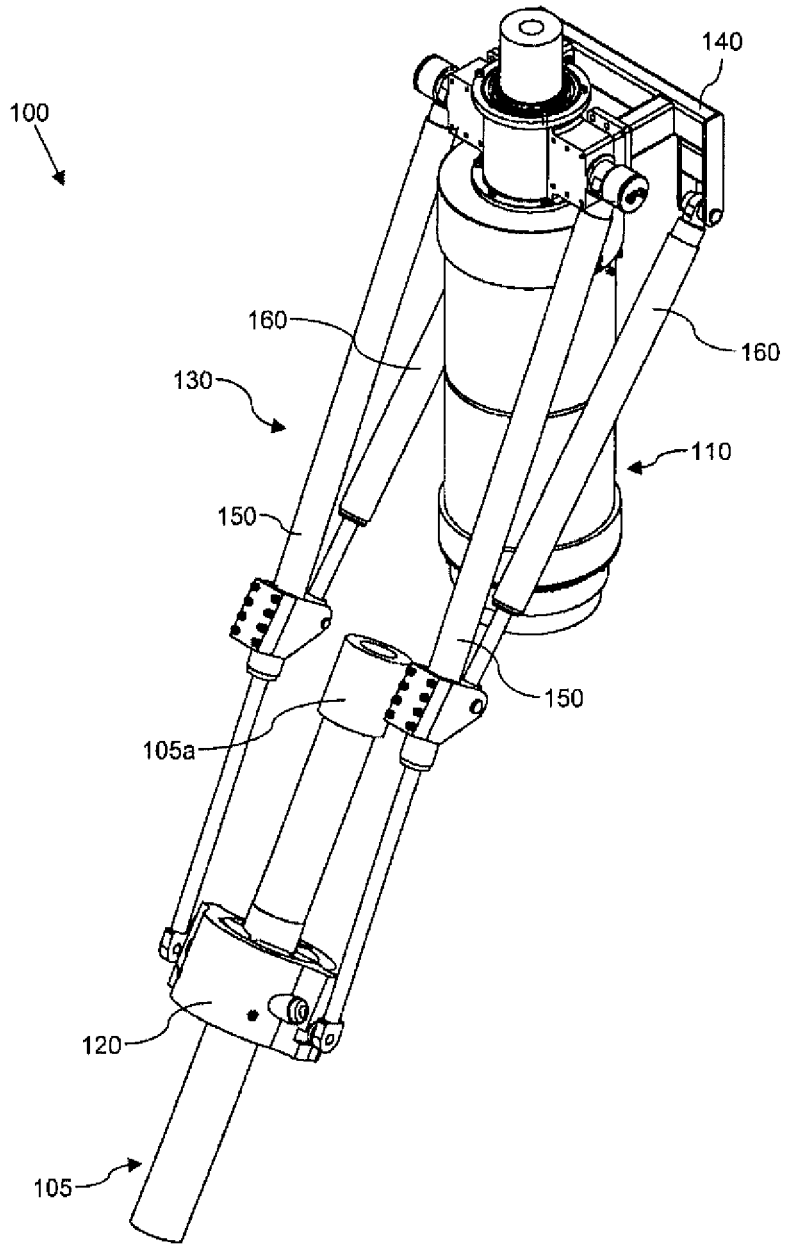
FIGS. 1B-G are perspective views of the apparatus shown in FIG. 1A in subsequent stages of operation.
Figure 1C:
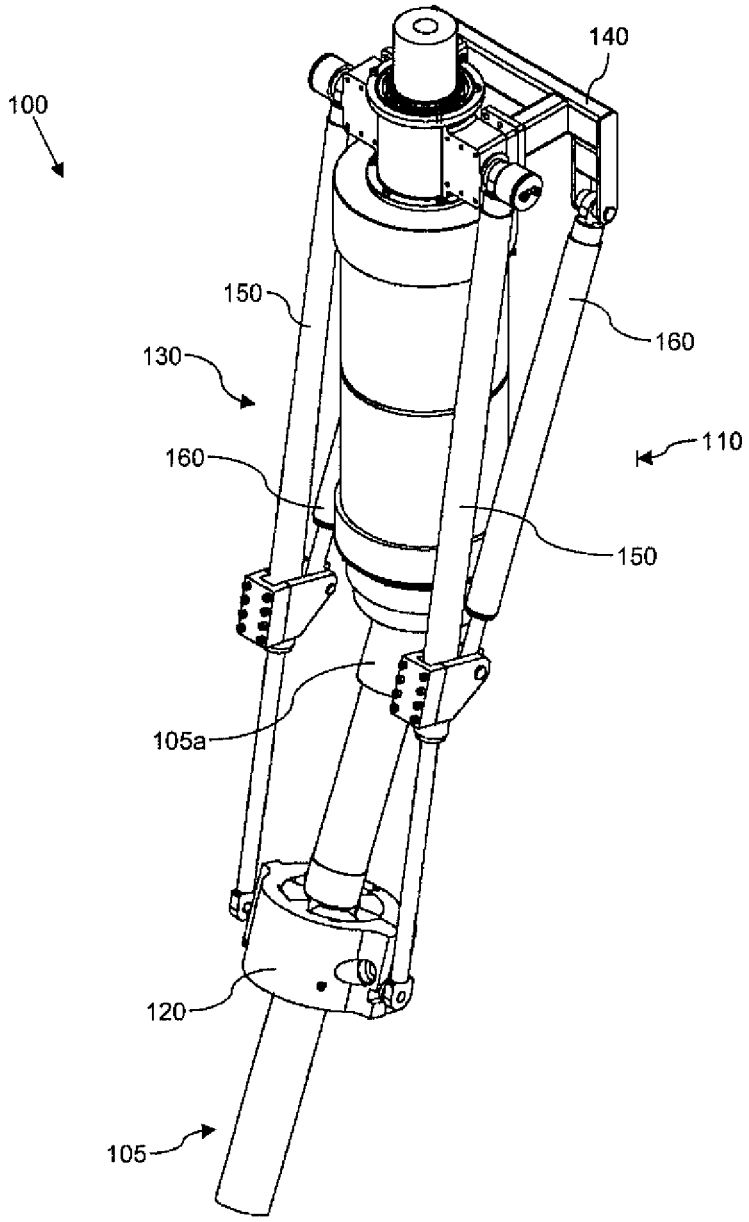
Figure 1D:
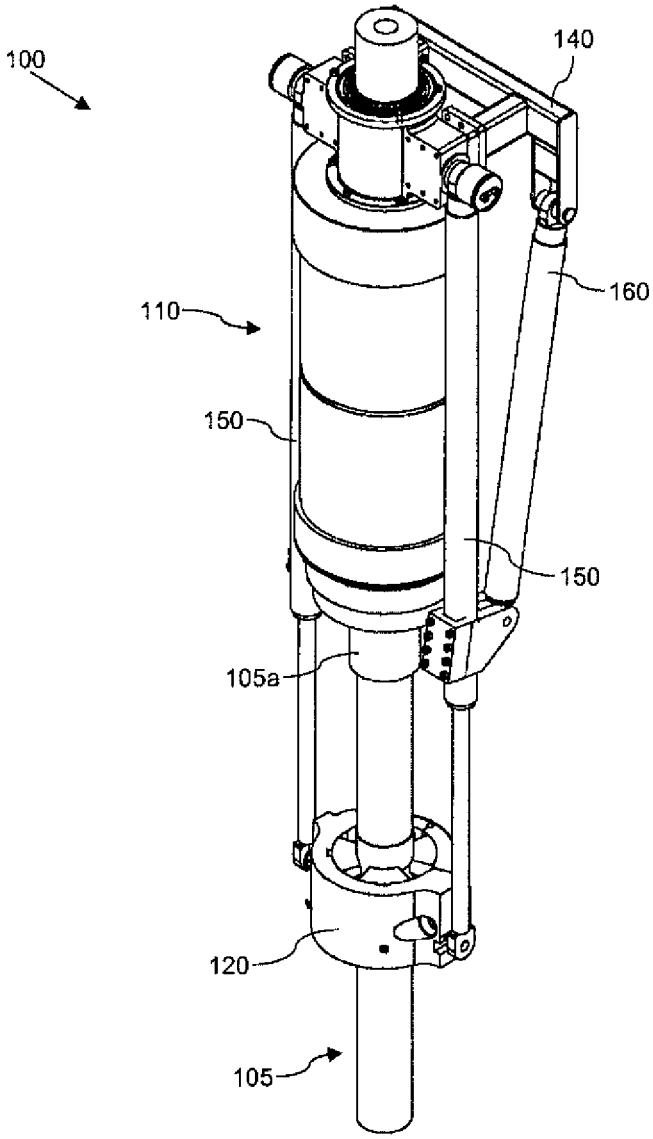

The actuators 150, 160 may be operated to position the elevator 120 around the intermediate portion 105*b* of the tubular member 105, as shown in FIG. 1A. The elevator 120 may subsequently be operated to grip or otherwise engage the tubular member 105. Then, as shown in FIG. 1B, the actuators 160 may be operated to rotate the elevator 120 and tubular member 105 towards the centerline of the drill string and/or running tool 110, such as by retracting the actuators 160 and thereby causing the actuators 150 to pivot about their attach points 150*a*. As this movement continues, the end 105*a* of the tubular member 105 is positioned in or near the bottom opening of the running tool 110, as shown in FIG. 1C. In an exemplary embodiment, this action continues until the elevator 120 and tubular member 105 are substantially coaxially aligned with the running tool 110, as shown in FIG. 1D.

Figure 1E:
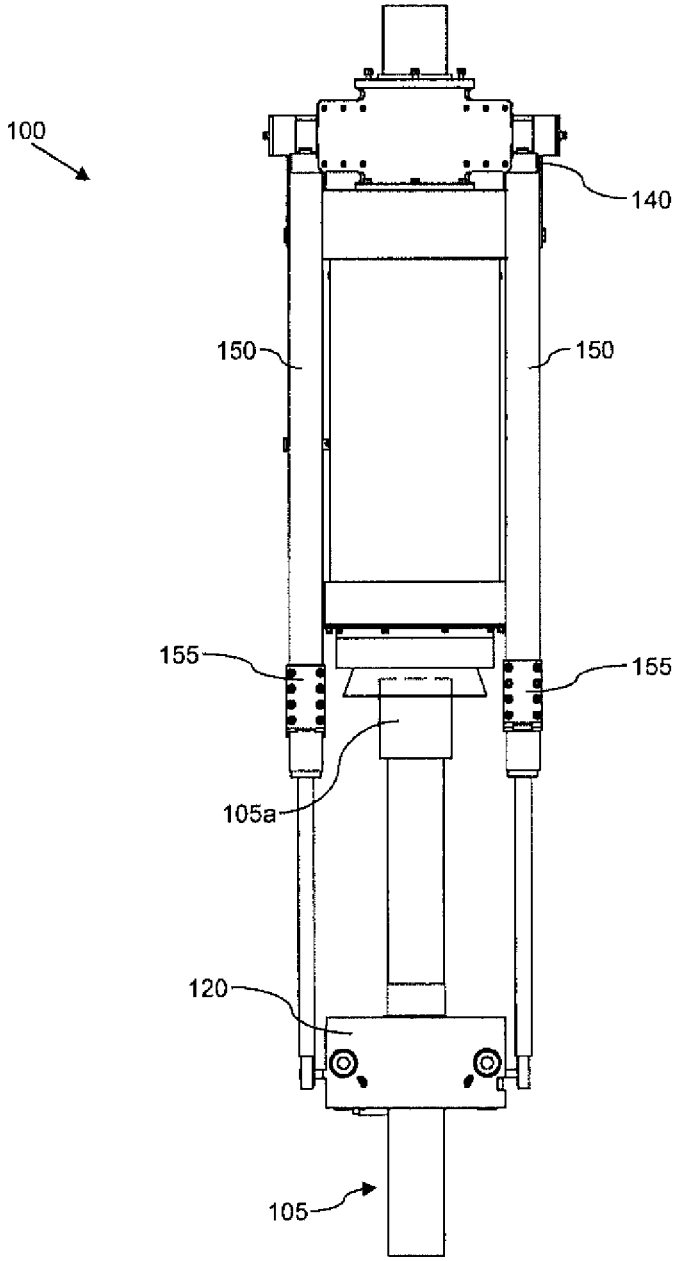
Figure 1F:
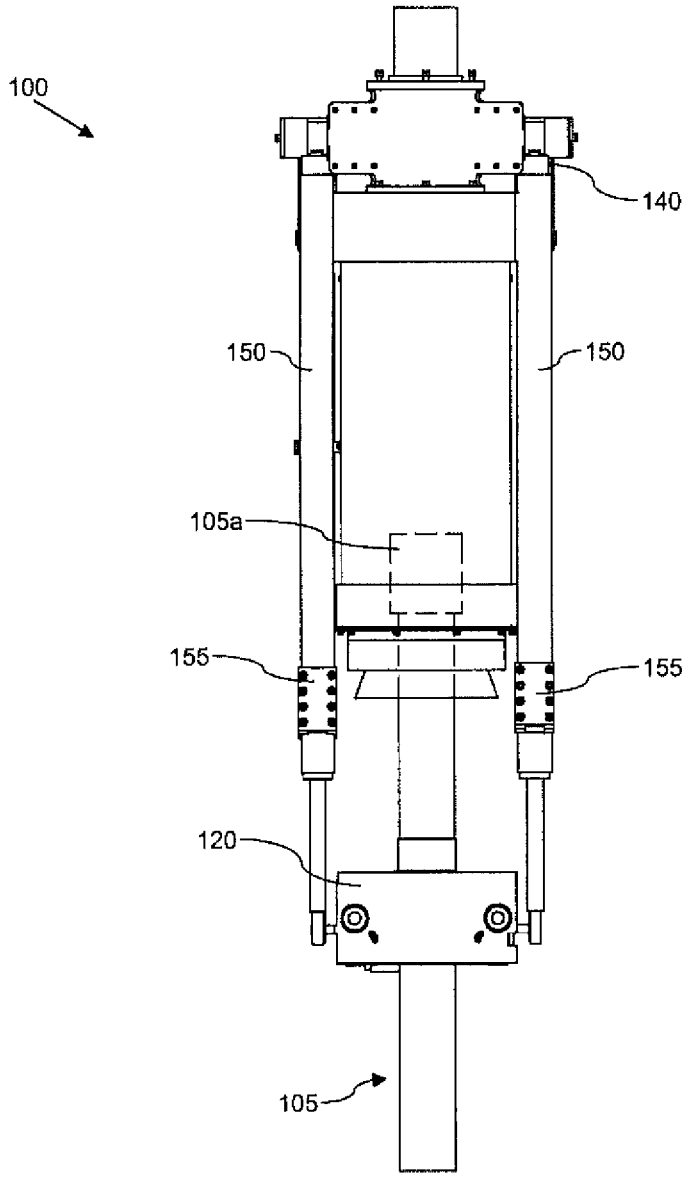
Figure 1G:
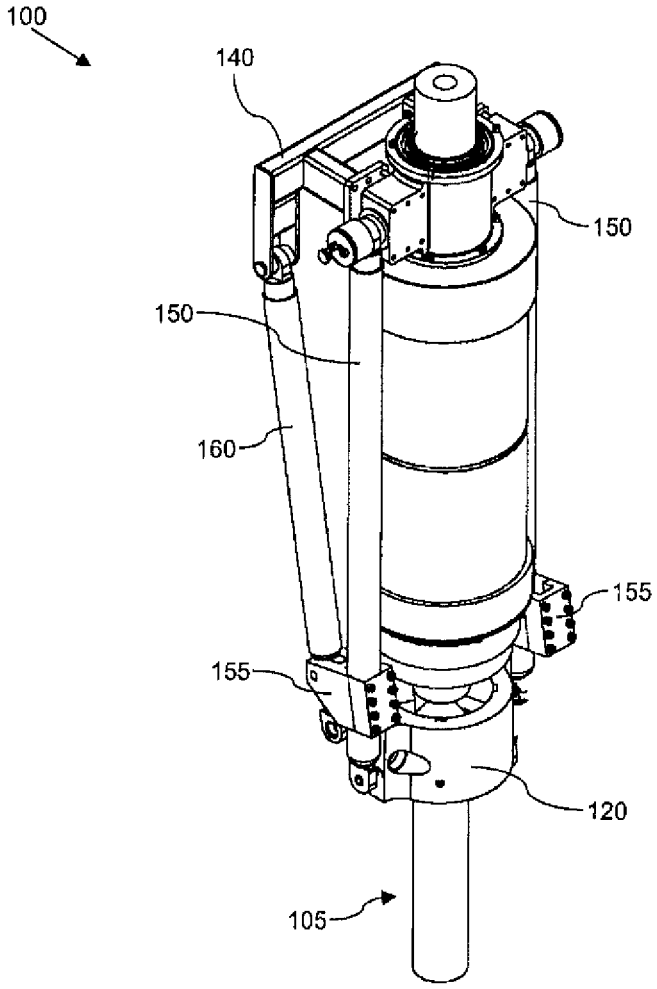

During subsequent steps of this procedure, the actuators 150 may be operated to insert the end 105*a* of the tubular member 105 into the running tool 110, as shown in FIGS. 1E, 1F, and 1G. For example, the actuators 150 may be retracted to pull the end 105*a* of the tubular member 105 into the running tool 110. As shown in FIG. 1G, the actuators 150 and the actuator 160 may be fully retracted, such that a significant portion of the end 105*a* of the tubular member 105 may be inserted into the running tool 110. The running tool 110 may be configured to subsequently engage the tubular member 105, such that the tubular member 105 is retained even after the elevator 120 subsequently disengages the tubular member 105.

Once the end 105*a* of the tubular member 105 is fully inserted into and engaged by the running tool 110, a portion of the running tool 110 may form a fluidic seal with the end 105*a* of the tubular member 105. For example, one or more flanges and/or other sealing components inside the running tool 110 may fit into and/or around the end 105*a* of the tubular member 105 to form the fluidic seal. Such sealing components may at least partially comprise a rubber or other pliable material. The sealing components may additionally or alternatively comprise metallic or other non-pliable material. In an exemplary embodiment, the sealing components may comprise a threaded connection, such as a conventional box-pin connection.

The process sequentially depicted in FIGS. 1A-G may be employed to remove a drill string joint or other tubular member (e.g., tubular member 105) from a pipe rack, other storage structure, handling tool, and/or other structure, and subsequently install the joint into a drill string or other tubular member string. However, the process sequentially depicted in FIGS. 1A-G may also be reversed to remove a tubular member from the string and, for example, set the removed tubular members down onto a pipe rack and/or other structure.

Figure 2:
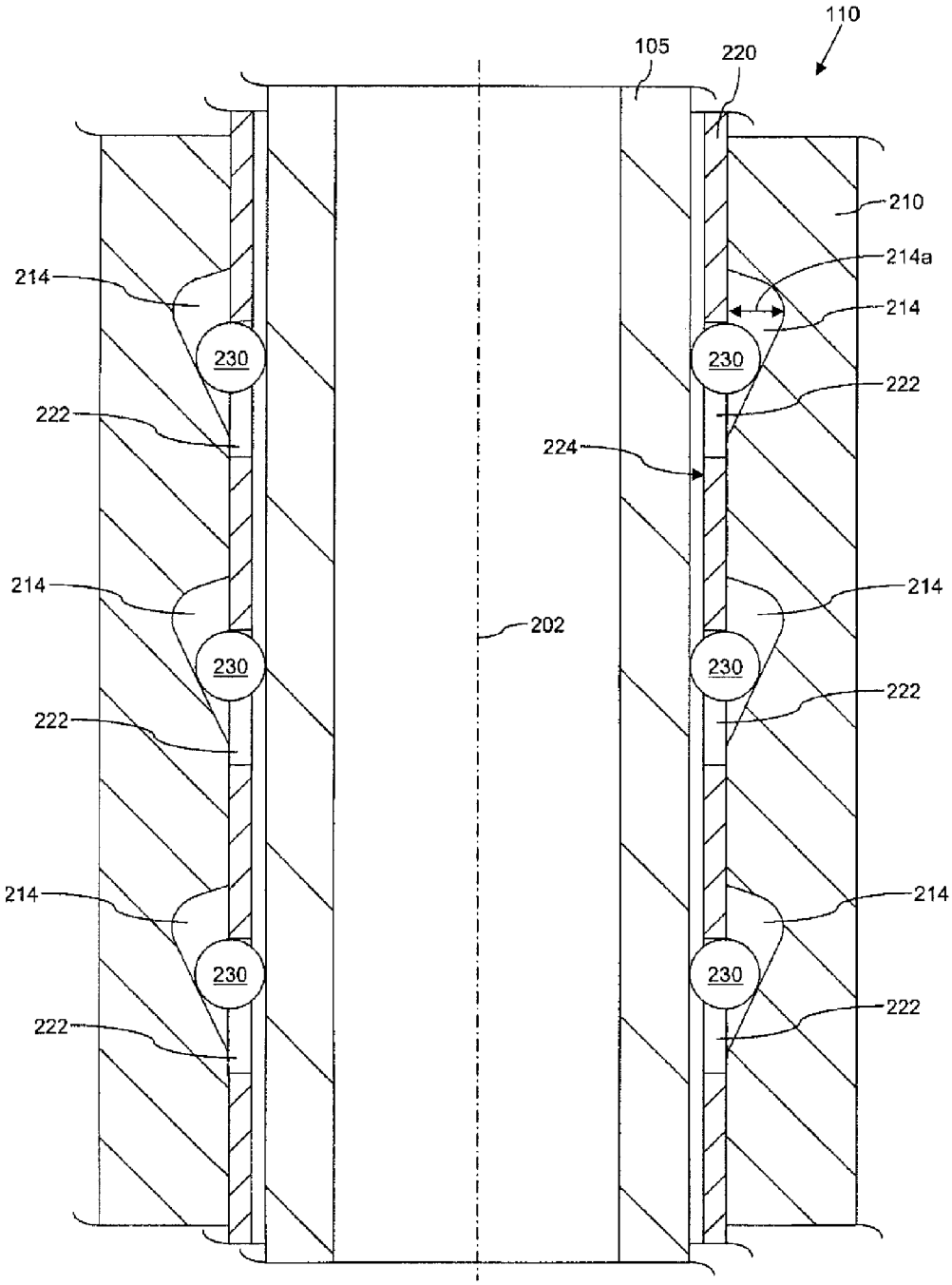
FIG. 2 is a sectional view of a portion of the apparatus shown in FIGS. 1A-G.

During such processes, the running tool 110 may be operated to engage the tubular members being installed into or removed from the drill string. Referring to FIG. 2, illustrated is a sectional view of at least a portion of an exemplary embodiment of the running tool 110 according to one or more aspects of the present disclosure. The running tool 110 includes a recessed member 210, a slotted or otherwise perforated member 220, and a plurality of rolling members 230.

The tubular member 105 may not be dimensionally uniform or otherwise ideal. That is, the tubular member 105 may not exhibit ideal roundness or circularity, such that all of the points on an outer surface of the tubular member at a certain axial position may not form a perfect circle. Alternatively, or additionally, the tubular member 105 may not exhibit ideal cylindricity, such that all of the points of the outer surface may not be equidistant from a longitudinal axis 202 of the running tool 110, and/or the tubular member 105 may not exhibit ideal concentricity, such that the axes of all cross sectional elements of the outer surface may not be common to the longitudinal axis 202.

The recessed member 210 may be or comprise a substantially cylindrical or otherwise shaped member having a plurality of recesses 214 formed therein. The perforated member 220, typically slotted but not limited to such a configuration, may be or comprise a substantially cylindrical or otherwise shaped annulus member having a plurality of slots (or otherwise-shaped apertures) 222 formed therein. Each slot 222 is configured to cooperate with one of the recesses 214 of the recessed member 210 to retain one of the rolling members 230. Moreover, each recess 214 and slot 222 are configured such that, when a rolling member 230 is moved further away from the maximum depth 214*a* of the recess 214, the rolling member 230 protrudes further through the slot 222 and beyond the perimeter 224 of the slotted member 220, and when the rolling member 230 is moved towards the maximum depth 214*a* of the recess 214, the rolling member 230 also moves towards a retracted position within the inner perimeter 224 of the slotted member 220.

Each slot 222 may have an oval or otherwise elongated profile, such that each slot 222 is greater in length than in width. The length of the slot 222 is in the direction of the longitudinal axis 202 of the running tool 110. The walls of each slot 222 may be tapered radially inward.

Each recess 214 may have a width (into the page in FIG. 2) that is at least about equal to or slightly larger than the width or diameter of each rolling member 230. Each recess 214 may also have a length that is greater than a minimum length of the slot 222. The width or diameter of the rolling member 230 is at least larger than the width of the internal profile of the slot 222.

Because each slot 222 is elongated in the direction of the taper of the recesses 214, each rolling member 230 may protrude from the slotted member 220 an independent amount based on the proximate dimensional characteristics of the tubular member 105. For example, if the outer diameter of the tubular member 105 is smaller near the end 105*a* of the tubular member 105, the rolling member 230 located nearest the end 105*a* of the tubular member 105 protrudes from the slotted member 220 a greater distance relative to the distance which the rolling member 230 nearest the central portion of the tubular member 105 protrudes from the slotted member 220.

Each of the rolling members 230 may be or comprise a substantially spherical member, such as a steel ball bearing. However, other materials and shapes are also within the scope of the present disclosure. For example, each of the rolling members 230 may alternatively be a cylindrical or tapered pin configured to roll up and down the ramps defined by the recesses 214.

Figure 3A:
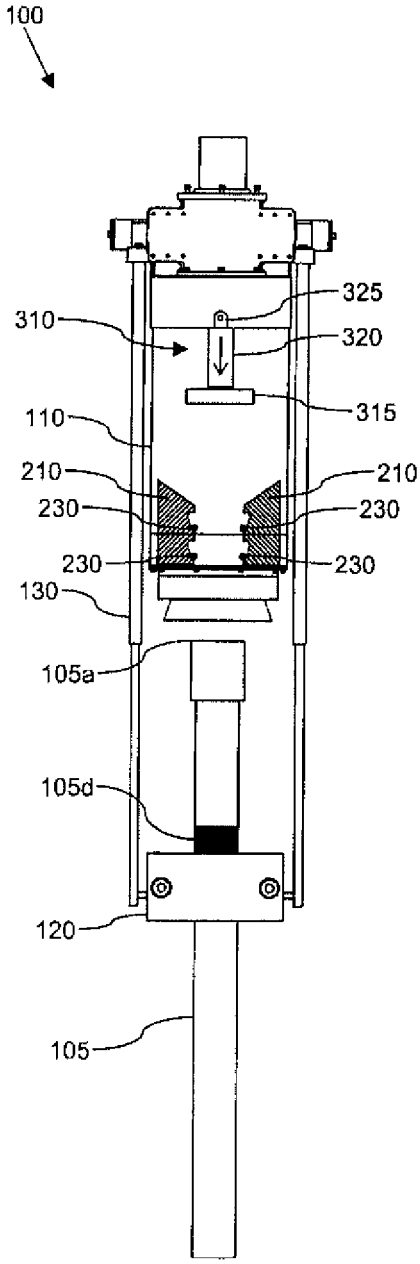
FIGS. 3A-D are partial sectional views of the apparatus shown in FIGS. 1A-G in a series of operational stages.

Referring to FIG. 3A, illustrated is a partial sectional view of the apparatus 100 shown in FIGS. 1A-G, including the embodiment of the running tool 110 shown in FIG. 2. In FIG. 3A, the apparatus 100 is depicted as including the tubular member running tool 110, the tubular member elevator 120, and the link tilt assembly 130 of FIGS. 1A-G. FIG. 3A further illustrates the recessed member 210 and rolling members 230 of the embodiment of the running tool 110 that is shown in FIG. 2. The embodiment of the apparatus 100 that is shown in FIG. 3A, however, may comprise additional components which may not be illustrated for the sake of clarity but may be understood to also exist.

Moreover, FIG. 3A also illustrates that the running tool 110 may comprise a preload mechanism 310. The preload mechanism 310 is configured to apply an axial force to the end 105*a* of the tubular member 105 once the tubular member 105 is inserted a sufficient distance into the running tool 110. For example, in the exemplary embodiment shown, the preload mechanism 310 includes a tubular member interface 315, an actuator 320, and a running tool interface 325. The tubular member interface 315 may be or comprise a plate and/or other structure configured to transfer the axial load supplied by the actuator 320 to the end 105*a* of the tubular member 105. The actuator 320 may be or comprise a linearly actuated cylinder which is operable hydraulically, electrically, mechanically, pneumatically, or via a combination thereof. The running tool interface 325 may be or comprise a threaded fastener, a pin, and/or other means for coupling the actuator 320 to the internal structure of the running tool 110.

In the configuration illustrated in FIG. 3A, the tubular member 105 has been engaged by the elevator 120 and subsequently oriented in substantial axial alignment underneath the running tool 110. The tubular member 105 may have a marking 105*d* which indicates the minimum offset required between the end 105*a* and the longitudinal position at which the tubular member 105 is engaged by the elevator 120.

Figure 3B:
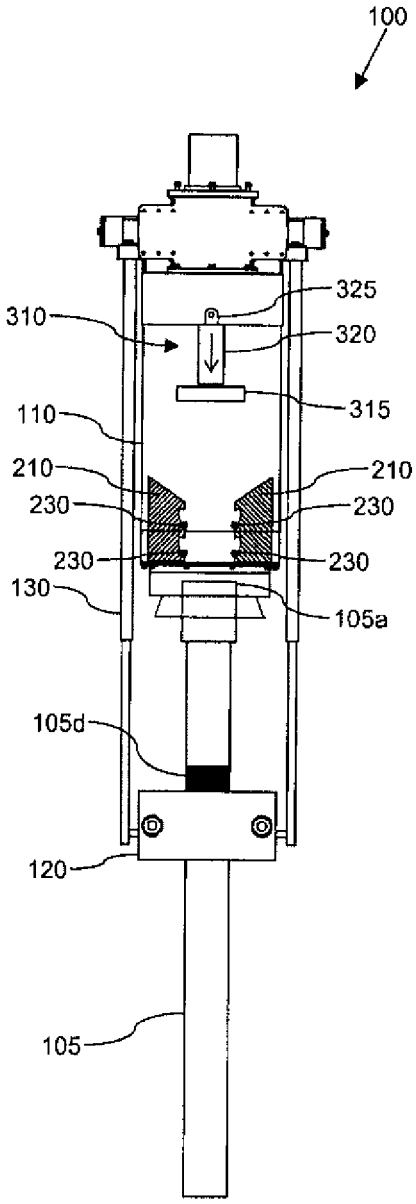

After the axial alignment depicted in FIG. 3A is achieved, the link tilt assembly 130 may be actuated to begin inserting the tubular member 105 into the running tool 110, as shown in FIG. 3B. As the tubular member 105 enters the running tool 110, the rolling members 230 slide and/or roll against the outer perimeter of the tubular member 105, thus applying very little radially-inward force to the tubular member 105. (Alternatively, the insert members 210 may be retracted to the extent that they do not touch the tubular member 105.) This continues until the end 105*a* of the tubular member 105 nears or abuts the tubular member interface 315 of the preload mechanism 310.

Figure 3C:
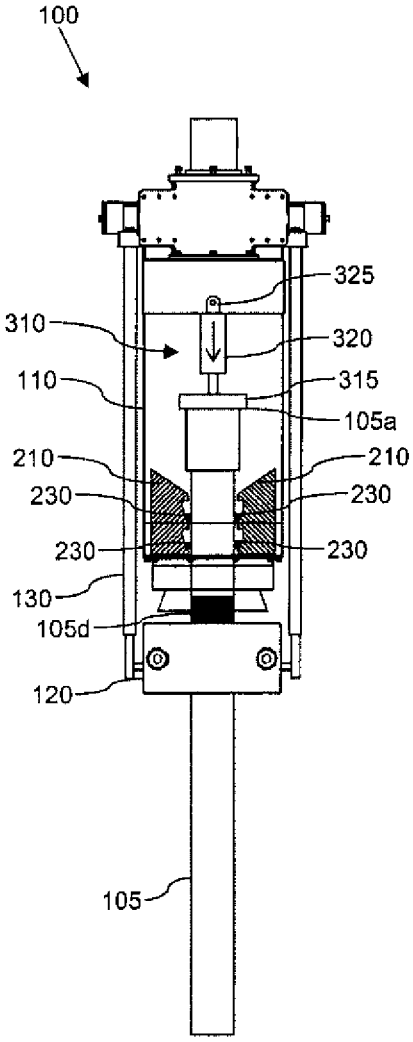

Subsequently, as shown in FIG. 3C, the members 210 move radially inward such that the rolling members 230 contact the surface of the tubular member 105, and the actuator 320 of the preload mechanism 310 is actuated to apply an axially-downward force to the end 105*a* of the tubular member 105. This downward force actively engages the rolling members 230 with the outer perimeter of the tubular member 105. Accordingly, the tubular member 105 is positively engaged by the running tool 110, and this engagement is caused by not only the weight of the tubular member 105 but also the axial force applied by the preload mechanism 310.

Figure 3D:
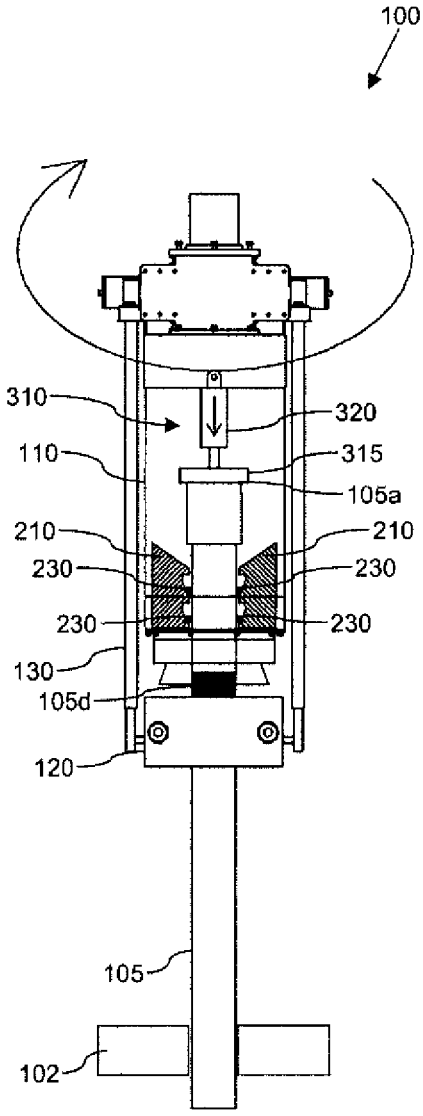

Consequently, as depicted in FIG. 3D, the running tool 110 may be rotated, which thereby rotates the tubular member 105. That is, the torque applied to the running tool 110 (e.g., by a top drive coupled directly or indirectly to the running tool 110) is transferred to the tubular member via the rolling members 230, among other components of the running tool 110. During such rotation, the elevator 120 may be disengaged from the tubular member 105, such that the entire weight of the tubular member 105 is supported by the running tool 110 (if not also the weight of a drill string attached to the tubular member 105).

To remove the engaged tubular member 105 from the running tool 110, the assembly of the tool 100 and the tubular member 105 is disengaged from the floor slips 102, and then the actuator 320 of the preload mechanism 310 is retracted to remove the axial force from the end 105*a* of the tubular member 105. The slotted member of the running tool (shown in FIG. 2 but not in FIGS. 3A-D) may also be translated upward by one or more actuators coupled thereto, such that the rolling members 230 may become free to disengage the tubular member 105. The assembly of the tool 100 and the tubular member 105 is then lowered to the desired position, the floor slips 102 are engaged, the rolling elements 230 are disengaged, and the inserts 210 are retracted to allow the upward movement of the tool 100, clearing it from the enlarged element 105*a*.

Figure 4:
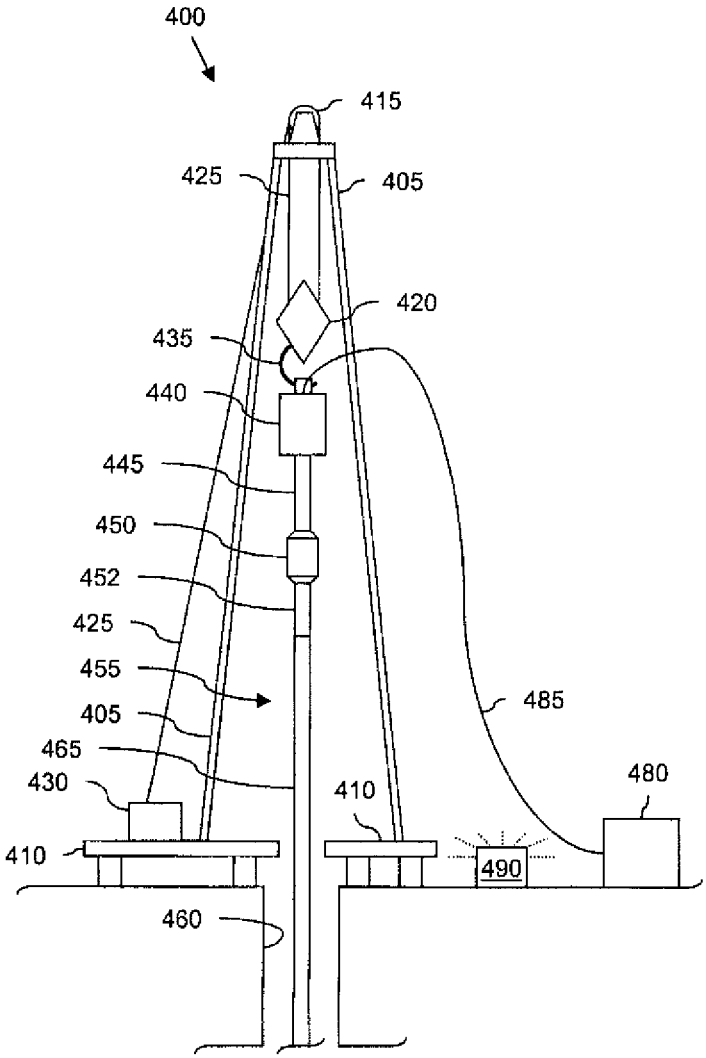
FIG. 4 is a schematic diagram of apparatus according to one or more aspects of the present disclosure.

Referring to FIG. 4, illustrated is a schematic view of apparatus 400 demonstrating one or more aspects of the present disclosure. The apparatus 400 demonstrates an exemplary environment in which the apparatus 100 shown in FIGS. 1A-G, 2, and 3A-D, and/or other apparatus within the scope of the present disclosure may be implemented.

The apparatus 400 is or includes a land-based drilling rig. However, one or more aspects of the present disclosure are applicable or readily adaptable to any type of drilling rig, such as jack-up rigs, semisubmersibles, drill ships, coil tubing rigs, and casing drilling rigs, among others.

Apparatus 400 includes a mast 405 supporting lifting gear above a rig floor 410. The lifting gear includes a crown block 415 and a traveling block 420. The crown block 415 is coupled at or near the top of the mast 405, and the traveling block 420 hangs from the crown block 415 by a drilling line 425. The drilling line 425 extends from the lifting gear to draw-works 430, which is configured to reel out and reel in the drilling line 425 to cause the traveling block 420 to be lowered and raised relative to the rig floor 410.

A hook 435 is attached to the bottom of the traveling block 420. A top drive 440 is suspended from the hook 435. A quill 445 extending from the top drive 440 is attached to a saver sub 450, which is attached to a tubular lifting device 452. The tubular lifting device 452 is substantially similar to the apparatus 100 shown in FIGS. 1A-G and 3A-D, among others within the scope of the present disclosure. As described above with reference to FIGS. 1A-G and 3A-D, the lifting device 452 may be coupled directly to the top drive 440 or quill 445, such that the saver sub 450 may be omitted.

The tubular lifting device 452 is engaged with a drill string 455 suspended within and/or above a wellbore 460. The drill string 455 may include one or more interconnected sections of drill pipe 465, among other components. One or more pumps 480 may deliver drilling fluid to the drill string 455 through a hose or other conduit 485, which may be connected to the top drive 440.

The apparatus 400 may further comprise a controller 490 configured to communicate wired or wireless transmissions with the drawworks 430, the top drive 440, and/or the pumps 480. Various sensors installed through the apparatus 400 may also be in wired or wireless communication with the controller 490. The controller 490 may further be in communication with the running tool 110, the elevator 120, the actuators 150, and the actuators 160 of the apparatus 100 shown in FIGS. 1A-G and 3A-D. For example, the controller 490 may be configured to substantially automate operation of the elevator 120, the actuators 150, and the actuators 160 during engagement of the elevator 120 and a tubular member 105. The controller 490 may also be configured to substantially automate operation of the running tool 110, the elevator 120, the actuators 150, and the actuators 160 during engagement of the running tool 110 and a tubular member 105.

Figure 5A:
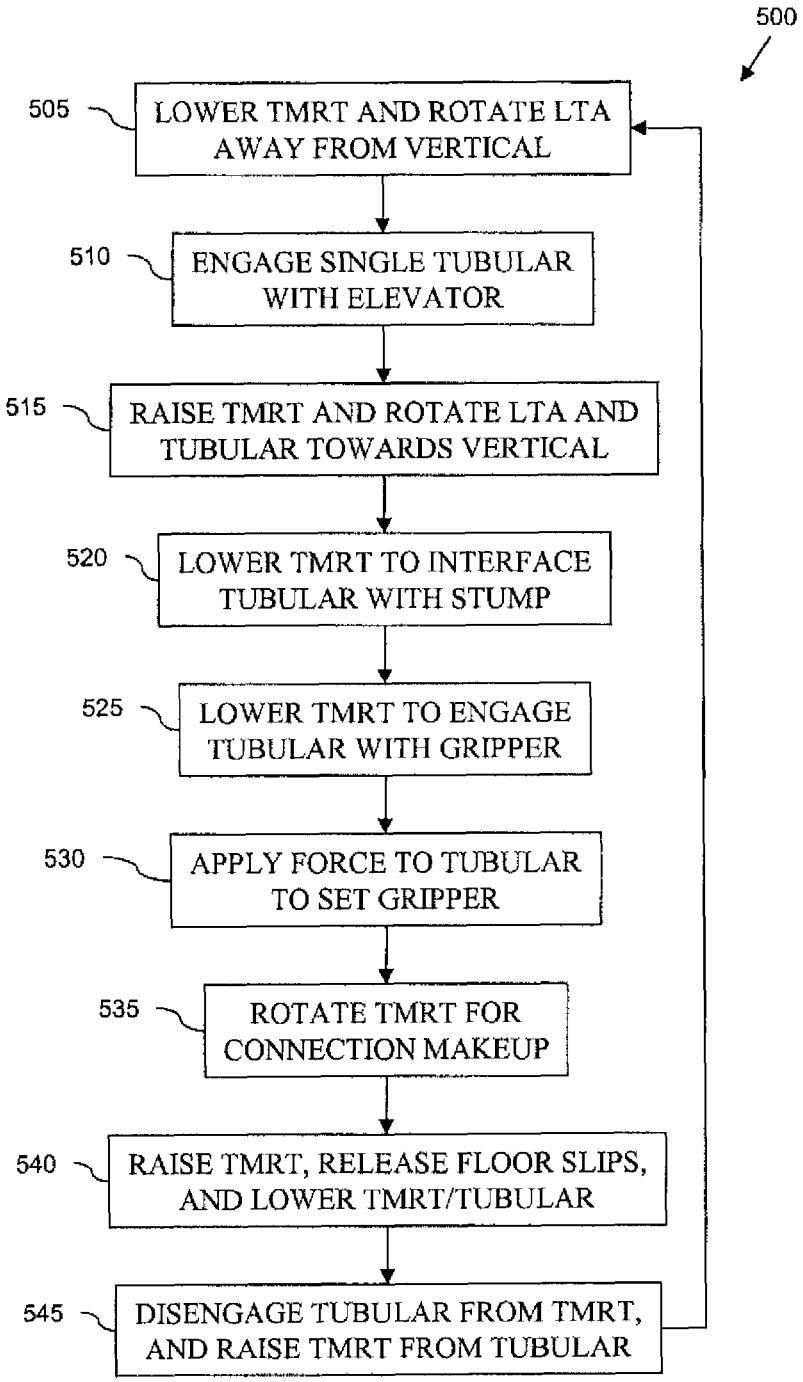
FIG. 5A is a flow-chart diagram of at least a portion of a method according to one or more aspects of the present disclosure.

Referring to FIG. 5A, illustrated is a flow-chart diagram of at least a portion of a method 500 according to one or more aspects of the present disclosure. The method 500 may be substantially similar to the method of operation depicted in FIGS. 1A-G and 3A-D, and/or may include alternative or optional steps relative to the method depicted in FIGS. 1A-G and 3A-D. The system 400 shown in FIG. 4 depicts an exemplary environment in which the method 500 may be implemented.

For example, the method 500 includes a step 505 during which the tubular member running tool (TMRT) is lowered relative to the rig, and the link tilt assembly (LTA) is rotated away from its vertical position. Additional positioning of the TMRT and LTA may be performed such that the elevator of the LTA is adequately positioned relative to the tubular member so that the LTA elevator can be operated to engage the tubular member in a subsequent step 510. Thereafter, the TMRT is raised and the LTA and tubular member are rotated into or towards the vertical position, substantially coaxial with the TMRT, in a step 515.

The TMRT is then lowered during a step 520 such that the tubular member is stabbed into or otherwise interfaced with the stump (existing tubular string suspended within the wellbore by floor slips and extending a short distance above the rig floor). In a subsequent step 525, the TMRT is further lowered to engage the upper end of the tubular member with the gripping mechanism within the TMRT. During an optional step 530, a preload and/or other force may then be applied to the tubular member, such as may set the gripping mechanism within the TMRT and thereby rigidly engage the tubular member with the gripping mechanism. The TMRT may then be rotated during a step 535 to make up the connection between the tubular member and the stump.

The method 500 may then proceed to a step 540 during which the TMRT is raised a short distance to release the floor slips and then lowered to position the tubular member as the new stump. In a subsequent step 545, the gripping mechanism of the TMRT may be disengaged to decouple the tubular member, and the TMRT may be raised in preparation for the next iteration of the method 500.

Figure 5B:
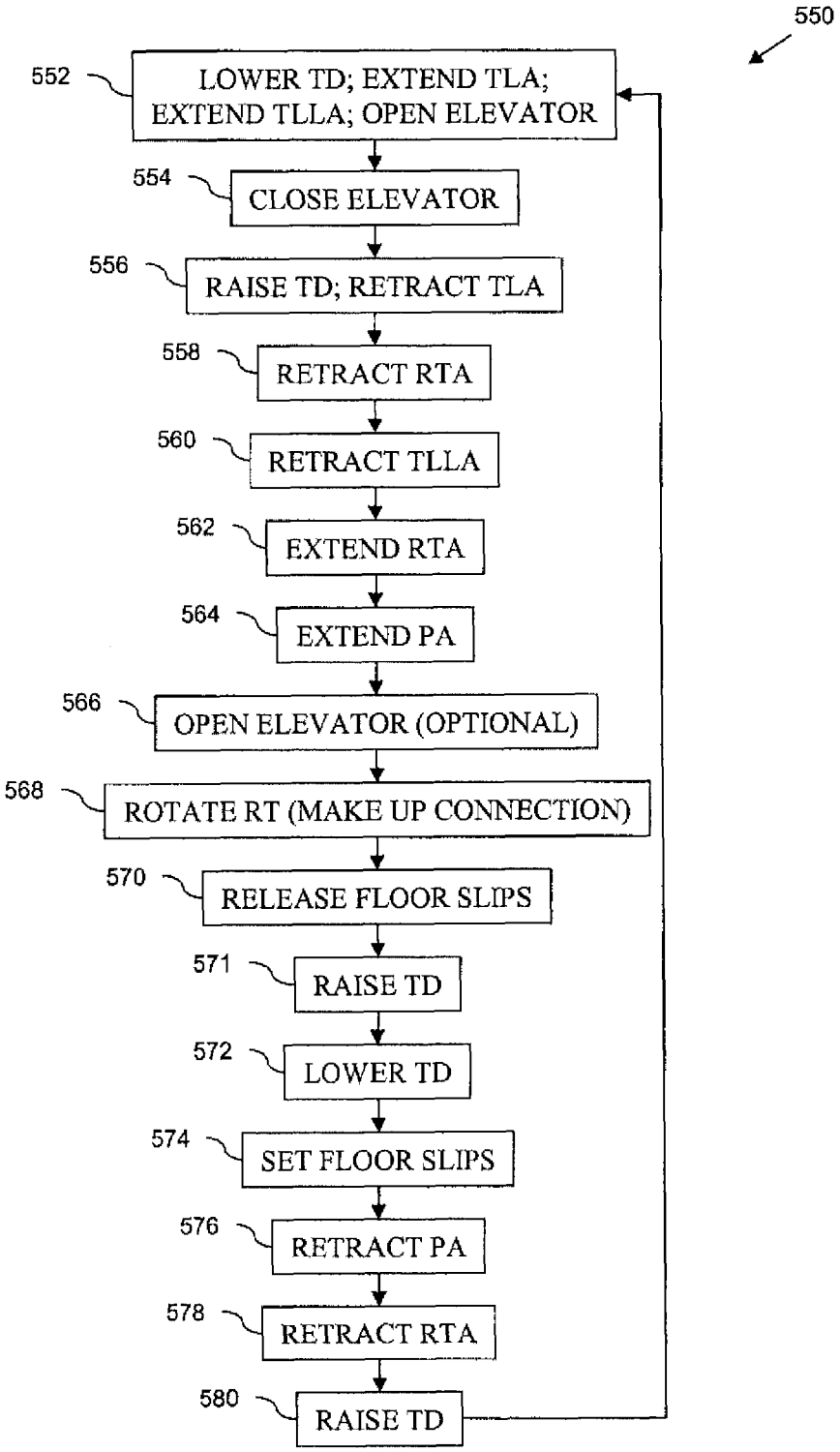
FIG. 5B is a flow-chart diagram of at least a portion of a method according to one or more aspects of the present disclosure.

Referring to FIG. 5B, illustrated is a flow-chart diagram of at least a portion of a method 550 according to one or more aspects of the present disclosure. The method 550 may be substantially similar to the method of operation depicted in FIGS. 1A-G, 3A-D, and 5A, and/or may include alternative or optional steps relative to the method depicted in FIGS. 1A-G, 3A-D, and 5A. For example, the method 550 may be performed to add one or more tubular members (singles, doubles, or triples) to an existing drill string that is suspended within a wellbore. The system 400 shown in FIG. 4 depicts an exemplary environment in which the method 550 may be implemented.

The method 550 includes a step 552 during which the top drive (TD) is lowered, the tilt link actuator (TLA) is extended, the tilt link load actuator (TLLA) is extended, and the elevator is opened. Two or more of these actions may be performed substantially simultaneously or, alternatively, step 552 may comprise performing these actions in series, although the particular sequence or order of these actions of step 552 may vary within the scope of the present disclosure. The actions of step 552 are configured to orient the elevator relative to the tubular member being installed into the drill string such that the elevator can subsequently engage the tubular member.

The TD may be or comprise a rotary drive supported above the rig floor, such as the rotary drive 440 shown in FIG. 4. The TLA comprises one or more components which tilt the TLLA and elevator out of vertical alignment with the TD, such as the actuators 160 shown in FIGS. 1A-G. The TLLA comprises one or more components which adjust the vertical position of the elevator relative to the TD, such as the actuators 150 shown in FIGS. 1A-G. The elevator may be or comprise a grasping element configured to engage the tubular member being assembled into the drill string, such as the tubular member elevator 120 shown in FIGS. 1A-G and 3A-D.

After orienting the elevator relative to the new tubular member by operation of the TD, TLA, and TLLA, as achieved by the performance of step 552, step 554 is performed to close the elevator or otherwise engage the new tubular member with the elevator. Thereafter, step 556 is performed, during which the TD is raised and the TLA is retracted. The actions of raising the TD and retracting the TLA may be performed substantially simultaneously or serially in any sequence. The TD is raised a sufficient amount such that the lower end of the new tubular member is positioned higher than the drill string stump protruding from the rig floor, and the retraction of the TLA brings the new tubular member into vertical alignment between the stump and the TD.

In a subsequent step 558, the running tool actuator (RTA) is retracted. The RTA may be or comprise a linearly actuated cylinder which is operable hydraulically, electrically, mechanically, pneumatically, or via a combination thereof. The RTA couples to a portion of the running tool (RT) such that the RT is able to grip the tubular member when the RTA is extended but is prevented from gripping the tubular member when the RTA is retracted.

The TLLA is then retracted during step 560, such that the end of the tubular member is inserted into the RT. In a subsequent step 562, the RTA is extended, thereby allowing the RT to grip the tubular member. The method 550 also includes a step 564 during which a preload actuator (PA) is extended to apply an axial force to the end of the tubular member and thus forcibly cause the engagement of the tubular member by the RT. The PA comprises one or more components configured to apply an axial force to the end of the tubular member within the RT, such as the actuator 320 and/or preload mechanism 310 shown in FIGS. 3A-D.

The method 550 may also include a step 566 during which the elevator may be opened, such that the tubular member is only retained by engagement with the RT. However, this action of opening the elevator may be performed at another point in the method 550, or not at all.

During a subsequent step 568, the RT is rotated such that a connection is made up between the new tubular member and the stump. In the present example, such rotation is driven by the rotational force provided by the top drive. However, other means for rotating the RT are also within the scope of the present disclosure.

After the connection is made up by performing step 568, the floor slips are released during step 570. The TD is then initially raised during step 571 to fully disengage the stump from the slips, and then lowered during step 572 to translate the newly joined tubular member into the wellbore such that only an end portion of the new tubular member protrudes from the rig floor, forming a new stump. The floor slips are then reset to engage the new stump during a subsequent step 574.

Thereafter, the PA is retracted during step 576, and the RTA is retracted during step 578, such that the new tubular member (now the stump) is engaged only by the floor slips and not any portion of the RT or elevator. The TD is then free to be raised during subsequent step 580. As indicated in FIG. 5B, the method 500 may then be repeated to join another tubular member to the new stump.

Figure 5C:
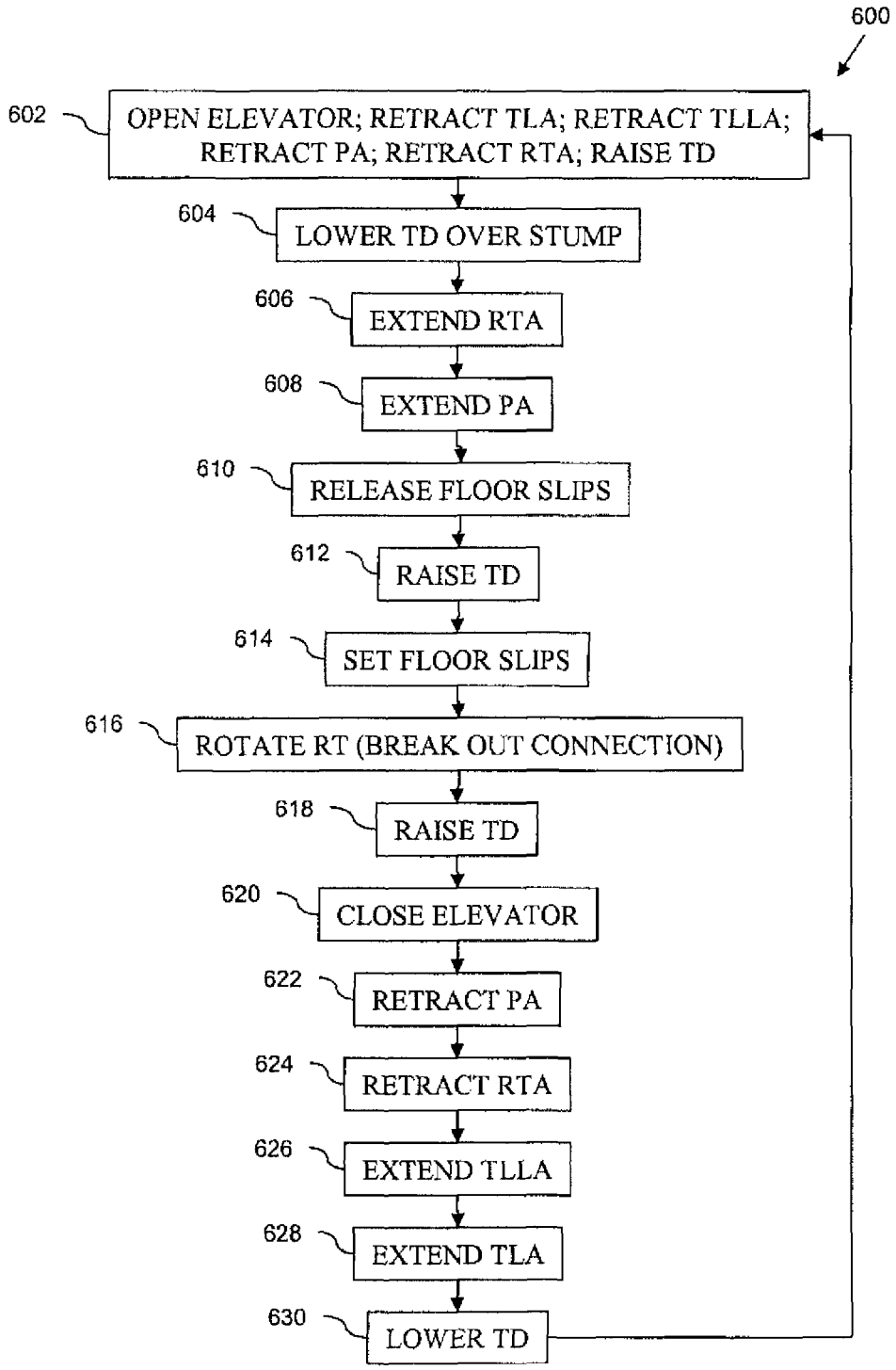
FIG. 5C is a flow-chart diagram of at least a portion of a method according to one or more aspects of the present disclosure.

Referring to FIG. 5C, illustrated is a flow-chart diagram of at least a portion of a method 600 according to one or more aspects of the present disclosure. The method 600 may be substantially similar to a reversed embodiment of the method of operation depicted in FIGS. 1A-G, 3A-D, and 5A-B, and/or may include alternative or optional steps relative to the method depicted in FIGS. 1A-G, 3A-D, and 5A-B. For example, the method 600 may be performed to remove one or more tubular members (singles, doubles, or triples) from an existing drill string that is suspended within a wellbore. The system 400 shown in FIG. 4 depicts an exemplary environment in which the method 600 may be implemented.

The method 600 includes a step 602 during which the elevator is opened, the TLA is retracted, the TLLA is retracted, the PA is retracted, the RTA is retracted, and the TD is raised. Two or more of these actions may be performed substantially simultaneously or, alternatively, step 602 may comprise performing these actions in series, although the particular sequence or order of these actions of step 602 may vary within the scope of the present disclosure. The actions of step 602 are configured to orient the elevator and RT relative to the protruding end (stump) of the tubular member being removed from the drill string such that the RT can subsequently engage the tubular member.

Thereafter, during step 604, the TD is lowered over the stump, such that the stump is inserted into the RT. The RTA is then extended during step 606, and the PA is then extended during step 608. Consequently, the stump is engaged by the RT. The floor slips are then released during step 610, and the TD is subsequently raised during step 612, such that the entire length of the tubular member being removed from the drill string is raised above the rig floor and the end of the next tubular member in the drill string protrudes from the wellbore. The floor slips are then reset to engage the next tubular member during step 614. In a subsequent step 616, the RT is rotated to break out the connection between the tubular member being removed and the next tubular that will form the new stump. After breaking the connection, the TD is raised during step 618, thereby lifting the tubular member off of the new stump.

Thereafter, during step 620, the elevator is closed to engage the removed tubular member which is still engaged by the RT. The PA is then retracted during step 622, and the TLLA is then retracted during step 624, such that the tubular member can become disengaged from the RT, yet it is still engaged by the elevator.

The TLLA is then extended during step 626. Because the tubular member is no longer engaged by the RT, the extension of the TLLA during step 626 pulls the tubular member out of the RT. However, step 626 may include or be proceeded by a process to fully disengage the RT from the tubular member, such as by lowering the TD to lightly set the removed tubular member down onto the stump or a protective plate positioned on the stump, after which the TD is raised once again so that the removed tubular member vertical clears the stump.

Thereafter, the TLA is extended during step 628 to tilt the removed tubular member (currently engaged by the elevator) away from vertical alignment with the TD. The TD is then lowered during step 630. The steps 628 and/or 630 may be performed to orient the removed tubular member relative a pipe rack or other structure or mechanism to which the tubular member will be deposited when the elevator is subsequently opened. The method 600 may further comprise an additional step during which the elevator is opened once the tubular member is adequately oriented. Alternatively, iteration of the method 600 may be performed such that the removed tubular member is deposited on the pipe rack or other structure or mechanism when the elevator is opened during the second iteration of step 602. As indicated in FIG. 5C, the method 600 may be repeated to remove additional tubular members from the drill string.

Figure 6:
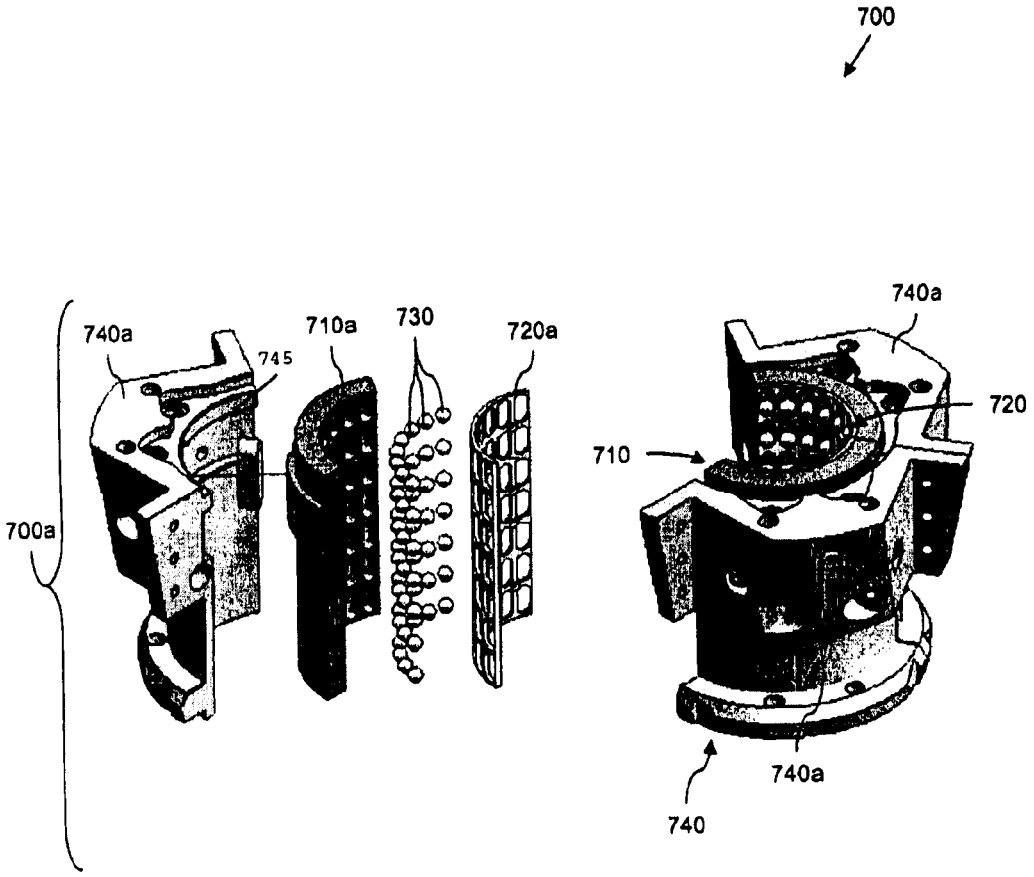
FIG. 6 is a sectional view of a portion of an embodiment of the apparatus shown in FIG. 2.

Referring to FIG. 6, illustrated is an exploded perspective view of at least a portion of an exemplary embodiment of the gripping mechanism of the TMRT 110 shown in FIGS. 1A-G, 2, and 3A-D, herein designated by the reference numeral 700. One or more aspects of the gripping mechanism 700 is substantially similar or identical to one or more corresponding aspects of the gripping mechanism of the TMRT 110 shown in FIGS. 1A-G, 2, and 3A-D. In an exemplary embodiment, the apparatus 700 shown in FIG. 6 is substantially identical to at least a portion of the TMRT 110 shown in FIGS. 1A-G, 2, and/or 3A-D.

The apparatus 700 includes a recessed member 710, a perforated member 720 whose apertures may be round or elongated, and a plurality of rolling members 730. One or more aspects of the recessed member 710 is substantially similar or identical to one or more corresponding aspects of the recessed member 210 shown in FIG. 2. One or more aspects of the perforated member 720 is substantially similar or identical to one or more corresponding aspects of the slotted member 220 shown in FIG. 2. The rolling members 730 may be substantially identical to the rolling members 230 shown in FIG. 2.

As shown in FIG. 6, however, the recessed member 710 and the slotted member 720 each comprise three discrete sections 710*a*, 720*a*, respectively. The apparatus 700 also includes in this embodiment a holder 740 which also comprises three discrete sections 740*a*. Other functionally equivalent configurations may combine section 740*a* and 710*c* to create an integral member. Each holder section 740*a* may include a flange 745 configured to be coupled with a flange 745 of another of the holder sections 740*a*, such that the holder sections 740*a* may be assembled to form a bowl-type structure (holder 740) configured to hold the sections 710*a* of the recessed member 710, the sections 720*a* of the slotted member 720, and the rolling members 730.

Figure 7A:
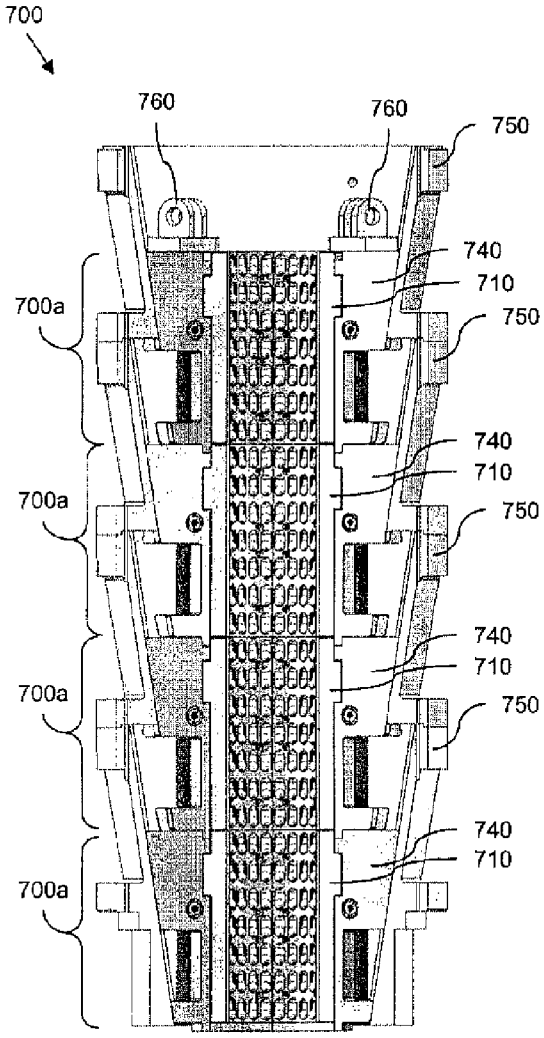
FIGS. 7A and 7B are perspective views of an embodiment of the apparatus shown in FIG. 6.
Figure 7B:
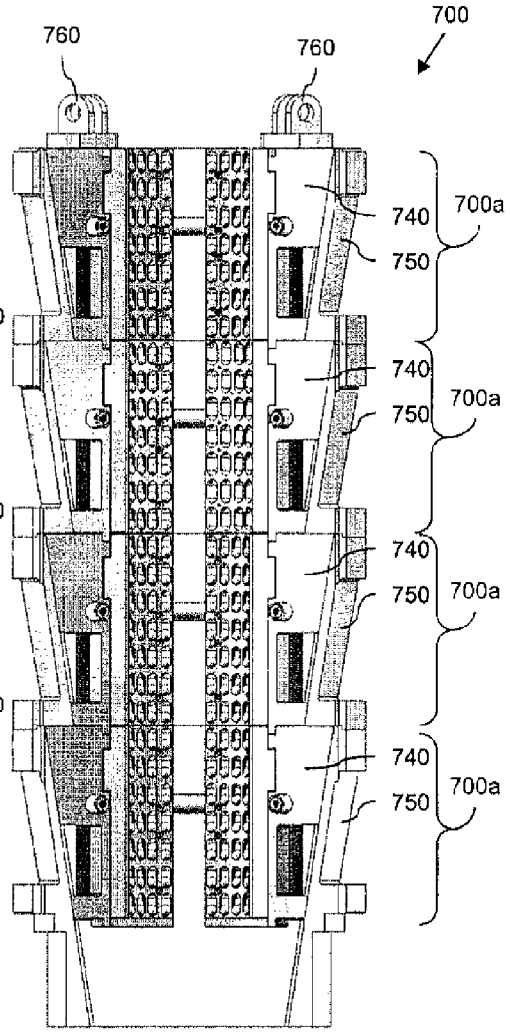

FIGS. 7A and 7B are perspective views of the apparatus 700 shown in FIG. 6 in engaged and disengaged positions, respectively. Referring to FIGS. 7A and 7B collectively, with continued reference to FIG. 6, the apparatus 700 may include multiple segments 700*a* stacked vertically. In the exemplary embodiment shown in FIGS. 7A and 7B, the apparatus 700 includes four vertical segments 700*a*. In other embodiments, however, the apparatus 700 may include fewer or more segments. The gripping force applied by the apparatus 700 to the tubular member is at least partially proportional to the number of vertical segments 700*a*, such that increasing the number of vertical segments 700*a* increases the lifting capacity of the apparatus 700 as well as the torque which may be applied to the tubular member by the apparatus 700. Each of the vertical segments 700*a* may be substantially similar or identical, although the top and bottom segments 700*a* may have unique interfaces for coupling with additional equipment between the top drive and the casing string.

The external profile of each holder 740 is tapered, such that the lower end of each holder 740 has a smaller diameter than its upper end. Each vertical segment 700*a* of the apparatus 700 also includes a housing 750 having an internal profile configured to cooperate with the external profile of the holder 740 such that as the holder 740 moves downward (relative to the housing 750) towards the engaged position (FIG. 7A) the holder 740 constricts radially inward, yet when the holder 740 moves upward towards the disengaged position (FIG. 7B) the holder 740 expands radially outward.

The top segment 700*a* of the apparatus 700 may include an interface 760 configured to couple with one or more hydraulic cylinders and/or other actuators (not shown). Moreover, each holder 740 is coupled to its upper and lower neighboring holders 740. Consequently, vertical movement urged by the one or more actuators coupled to the interface 760 results in simultaneous vertical movement of all of the holders 740. Accordingly, downward movement of the holders 740 driven by the one or more actuators causes the rolling members 730 to engage the outer surface of the tubular member, whereas upward movement of the holders 740 driven by the one or more actuators causes the rolling members 730 to disengaged the tubular member. The force applied by the one or more actuators to drive the downward movement of the holders 740 to engage the rolling members 730 with the tubular member is one example of the preload or other force described above with regard to step 530 of the method 500 shown in FIG. 5A, the step 564 shown in FIG. 5B, and/or the step 608 shown in FIG. 5C.

In view of all of the above and the exemplary embodiments depicted in FIGS. 1A-1G, 2, 3A-D, 4, 5A-C, 6, 7A and 7B, it should be readily apparent that the present disclosure introduces an apparatus for handling a tubular member, comprising: a tubular member running tool; a tubular member elevator; a plurality of first actuators each extending between the running tool and the elevator; and a plurality of second actuators each extending between the running tool and a corresponding one of the first actuators, wherein each of the first and second actuators is hydraulically- or electrically-operable. The running tool comprises: a slotted or perforated member having a plurality of apertures which may be elongated slots each extending in a direction; a recessed member slidably coupled to the slotted member and having a plurality of recesses each tapered in the direction from a shallow end to a deep end; and a plurality of rolling members each retained between one of the plurality of recesses and one of the plurality of apertures. Each of the plurality of rolling members partially extends through an adjacent one of the plurality of elongated slots when located in the shallow end of the corresponding one of the plurality of recesses, and each of the plurality of rolling members retracts to within an outer perimeter of the slotted member when located in a deep end of the corresponding one of the plurality of recesses.

The elevator may comprise: a slotted elevator member having a plurality of apertures which may be elongated slots each extending in a direction; a recessed elevator member slidably coupled to the slotted elevator member and having a plurality of recesses each tapered in the direction from a shallow end to a deep end; and a plurality of rolling elevator members each retained between one of the plurality of recesses and one of the plurality of elongated slots. Each of the plurality of rolling elevator members partially extends through an adjacent one of the plurality of elongated slots when located in the shallow end of the corresponding one of the plurality of recesses, and each of the plurality of rolling elevator members retracts to within an outer perimeter of the slotted elevator member when located in a deep end of the corresponding one of the plurality of recesses.

The running tool may be configured to frictionally engage an outer surface of the tubular member sufficient to apply a torque to the tubular member. In an exemplary embodiment, the torque is at least about 5000 ft-lbs. In another exemplary embodiment, the torque is at least about 50,000 ft-lbs.

Each first actuator may comprise a first cylinder having a first end and a second end, wherein the first end is rotatably coupled to a first attachment point of the running tool, and wherein a first rod extends from the second end and is rotatably coupled to the elevator. Each second actuator may comprise a second cylinder having a first end and a second end, wherein the first end of the second cylinder is rotatably coupled to a second attachment point of the running tool, and wherein a second rod extends from the second end of the second cylinder and is rotatably coupled to the first cylinder.

The tubular member may be selected from the group consisting of: a wellbore casing member; a drill string tubing member; a pipe member; and a collared tubing member. The running tool may be configured to frictionally engage the tubular member, wherein a portion of the running tool forms a fluidic seal with an end of the tubular member when the running tool is engaged with the tubular member.

The apparatus may further comprise a controller in communication with the running tool, the elevator, and the first and second actuators. The controller may be configured to substantially automate operation of the elevator and the first and second actuators during engagement of the elevator and the tubular member. Thus automation may include but is not limited to the counting of rotations, the measurement and application of torque, and the control of the rotations per unit of time of the apparatus, among other possible automated aspects. The elevator may be configured to engage an outer surface of an axially-intermediate portion of the tubular member. The controller may be configured to substantially automate operation of the running tool, the elevator, and the first and second actuators during engagement of the running tool and the tubular member. The running tool may be configured to engage an outer surface of another axially-intermediate portion of the tubular member.

The present disclosure also introduces a method of handling a tubular member, comprising: engaging an outer surface of an axially-intermediate portion of the tubular member with a tubular member elevator, and operating a plurality of links extending between the elevator and a tubular member running tool to thereby position an end of the tubular member within the running tool. The method further comprises engaging an outer surface of another portion of the tubular member with the running tool, including applying an axial force to the end of the tubular member within the running tool. Applying an axial force to the end of the tubular member may comprise actuating a hydraulic cylinder or other hydraulic or electric device to move a recessed member of a gripping mechanism relative to a housing of the gripping mechanism, thereby causing a plurality of rolling members of the gripping mechanism to each engage the tubular member.

The method may further comprise disengaging the tubular member elevator from the tubular member; and disengaging the running tool from the tubular member. Disengaging the running tool from the tubular member may comprise removing the axial force applied to the end of the tubular member within the running tool. The method may further comprise rotating the tubular member by rotating the running tool while the tubular member is engaged by the running tool, including applying a torsional force to the tubular member, wherein the torsional force is not less than about 5000 ft-lbs.

The present disclosure also provides an apparatus for handling a tubular member, comprising: means for engaging an outer surface of an axially-intermediate portion of the tubular member; means for positioning the engaging means to thereby position an end of the engaged tubular member within a running tool; and means for applying an axial force to the end of the tubular member within the running tool to thereby engage an outer surface of another portion of the tubular member with the running tool.

The ability to grip a tubular member at a position distal from the end (e.g., within an intermediate portion defined by a gripping limit), coupled with the ability to lift the tubular member without damaging the tubular member, and subsequently insert the tubular member into a handling tool, all with no or minimal human handling of the tubular member, is something that has not been done before, and satisfies and long-felt need in industry. One or more aspects of the present disclosure may facilitate gripping techniques which may allow an elevator to grip and lift or lower a tubular member without damaging its sensitive outer surface. One or more aspects of the present disclosure may also significantly improve the time it takes to add each new tubular member into the wellbore string, such as may be due to reducing the process time previously required for handling each tubular member and making the connections. However, other benefits and advantages may also be within the scope of the present disclosure.

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. A method of handling a tubular member, the tubular member comprising axially-opposed ends, the method comprising:

positioning one of the axially-opposed ends of the tubular member within a running tool;

engaging at least one surface of the tubular member with the running tool;

supporting the tubular member and lowering the engaged running tool relatively towards the supported tubular member;

first applying an axial force to the one of the axially-opposed ends of the engaged tubular member;

engaging at least one gripping assembly within the running tool so that the at least one gripping assembly grips the outer perimeter of the tubular member and, as a result, the at least one gripping assembly is positively engaged with the tubular member to support the load thereof; and then operating the running tool to move the tubular member with the at least one gripping assembly;

wherein the positive engagement of the at least one gripping assembly with the tubular member permits the movement of the tubular member with the at least one gripping assembly;

and wherein the positive engagement of the at least one gripping assembly with the tubular member is caused, at least in part, by first applying the axial force to the one of the axially-opposed ends of the engaged tubular member.

2. The method of claim 1, wherein a plurality of rolling members in the gripping assembly move from an engaged position adjacent the tubular to a gripping position that holds the tubular when the axial force is applied.

3. The method of claim 2, wherein at least a portion of the axial force is transferred through the tubular to at least a portion of the plurality of rolling members.

4. The method of claim 1, which further comprises:

engaging at least one surface of an axially-intermediate portion of the tubular member with a tubular member elevator, wherein the positioning the end of the tubular comprises operating a plurality of links extending between the elevator and a tubular member running tool, wherein supporting the tubular comprises engaging and gripping a different portion of the tubular member, and wherein the gripping assembly comprises a plurality of recessed, rolling members.

5. The method of claim 4, which further comprises:

disengaging the tubular member elevator from the tubular member; and disengaging the running tool from the tubular member.

6. The method of claim 5, wherein disengaging the running tool comprises releasing the axial force applied to the one of the axially-opposed ends of the tubular member within the running tool.

7. The method of claim 4, wherein the tubular member includes a radially enlarged shoulder relative to the remaining length, and wherein the tubular member elevator is engaged with the tubular when the at least one surface of the tubular member is engaged with the running tool.

8. The method of claim 4, wherein the tubular member elevator engages an outer surface of the tubular member.

9. The method of claim 4, wherein the plurality of links comprise actuators that are rotatably coupled to the running tool, the elevator, corresponding link actuators, or an intermediate structure coupled thereto.

10. The method of claim 4, wherein engaging the at least one surface of an axially-intermediate portion of the tubular member with a tubular member elevator further comprises lowering a top drive (TD), extending a tilt link actuator (TLA), extending a tilt link load actuator, or a combination thereof.

11. The method of claim 1, which further comprises rotating a portion of the running tool so as to rotate the gripped tubular member including by applying a torsional force of not less than about 5000 ft-lbs.

12. A method of engaging at least one surface of a tubular member with a running tool, the tubular member comprising axially-opposed ends, the method comprising:

retaining a plurality of rolling members each within a deep end of a recess of a recessed member in the running tool, which recess has a deep end and a shallow end;

moving the tubular member a sufficient distance into an end of the running tool so that the tubular member may be gripped by the running tool;

moving the plurality of rolling members towards each such surface of the tubular member to be gripped;

contacting the plurality of rolling members to each such surface of the tubular member to be gripped; and applying a preload force to one of the axially-opposed ends of the tubular member after contacting the plurality of rolling members to each such surface of the tubular member.

13. The method of claim 12, which further comprises moving the recessed member at least radially inward towards the tubular member to position the plurality of rolling members in contact with each such surface of the tubular member.

14. The method of claim 12, which further comprises moving the plurality of rolling members at least partially through a slot while each moves towards the shallow end of the recess and into contact with each such surface of the tubular member.

15. The method of claim 12, which further comprises retaining a plurality of rolling members within the shallow end of the recess while contacting the plurality of rolling members with each such surface of the tubular member.

16. The method of claim 12, wherein the at least one surface is selected to comprise an interior surface of the tubular member.

17. The method of claim 12, wherein the recessed member moves more in an axially downward direction than radial direction relative to the tubular member when contacting the plurality of rolling members with each such surface of the tubular member.

18. The method of claim 12, wherein the recessed member is selected to comprise a plurality of recessed member segments so that the recessed member has a rounded outer surface when the recessed member segments are collectively in an engaged position with the tubular member.

19. The method of claim 12, wherein the recessed member is selected to comprise a plurality of vertically stacked sections of recessed members to enable engagement axially along an end of a tubular member in the running tool.

20. The method of claim 12, wherein the moving of the plurality of rolling members comprises rolling, sliding, or a combination thereof.

21. The method of claim 12, which further comprises transferring an applied torque to the tubular member only through the running tool.

22. The method of claim 12, which further comprises releasing the plurality of rolling members by moving them downwards relative to the tubular member.

23. A method, comprising:

engaging a running tool with a tubular member, the tubular member comprising axially-opposed ends, the running tool comprising a gripping assembly, the gripping assembly including a plurality of gripping elements, wherein engaging the running tool with the tubular member comprises:

moving the tubular member a sufficient distance into the running tool so that the tubular member may be gripped by the running tool;

applying an axial force to one of the axially-opposed ends of the tubular member, and gripping the tubular member by placing the plurality of gripping elements in a gripping position in response to applying the axial force to the one of the axially-opposed ends of the tubular member;

removing the axial force applied to the one of the axially-opposed ends of the tubular member;

lowering the gripping assembly including the plurality of gripping elements in a direction towards the tubular member to release the plurality of gripping elements from the gripping position;

retracting the gripping assembly from a contact position with the tubular member to another position where the gripping assembly cannot grip the tubular member; and moving the running tool away from the tubular member so as to be able to receive another tubular member.

24. The method of claim 23, wherein removing the axial force comprises retracting an actuator of a preload mechanism.

* * * * *